US012753965B2

(12) United States Patent
Chung et al.

(10) Patent No.: US 12,753,965 B2
(45) Date of Patent: Oct. 6, 2026

(54) STOREHOUSE

(71) Applicant: LG ELECTRONICS INC., Seoul (KR)

(72) Inventors: Myungjin Chung, Seoul (KR); Kyungseok Kim, Seoul (KR); Yoonseong Nam, Seoul (KR); Jeongwon Park, Seoul (KR); Sounguk Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 27 days.

(21) Appl. No.: 18/577,437

(22) PCT Filed: Jul. 6, 2022

(86) PCT No.: PCT/KR2022/009799
§ 371 (c)(1),
(2) Date: Jan. 8, 2024

(87) PCT Pub. No.: WO2023/282640
PCT Pub. Date: Jan. 12, 2023

(65) Prior Publication Data

US 2024/0191938 A1 Jun. 13, 2024

(30) Foreign Application Priority Data

Jul. 8, 2021 (KR) ..... 10-2021-0089691

(51) Int. Cl.
*F25D 23/06* (2006.01)
*F25D 21/04* (2006.01)
(Continued)

(52) U.S. Cl.
CPC ..... *F25D 23/061* (2013.01); *F25D 23/006* (2013.01); *F25D 23/087* (2013.01);
(Continued)

(58) Field of Classification Search
CPC .... F25D 23/061; F25D 23/006; F25D 23/087; F25D 23/12; F25D 21/04; F25D 23/028;
(Continued)

(56) References Cited

U.S. PATENT DOCUMENTS

2019/0145698 A1* 5/2019 Scalf ..... F25D 23/087 62/466
2019/0170425 A1* 6/2019 Takami et al. ..... F25D 21/08
(Continued)

FOREIGN PATENT DOCUMENTS

CN 105716320 A * 6/2016 ..... F25B 21/02
CN 107588590 1/2018
(Continued)

OTHER PUBLICATIONS

CN 105716320 A Translation (Year: 2016).*
(Continued)

*Primary Examiner* — Jerry-Daryl Fletcher
*Assistant Examiner* — Dario Antonio Deleon
(74) *Attorney, Agent, or Firm* — KED & ASSOCIATES, LLP

(57) ABSTRACT

A storehouse may include a first storage space configured to provide a space in which goods are stored within a predetermined temperature or a predetermined temperature range and a second storage space configured to provide a space in which a first heat exchanger is accommodated. The storehouse may include a third storage space configured to
(Continued)

provide a space in which a second heat exchanger is accommodated. The storehouse may include a sealing member provided in a portion where the first storage space and the second storage space are in contact with each other.

17 Claims, 36 Drawing Sheets

(51) Int. Cl.

| | |
|---|---|
| ***F25D 23/00*** | (2006.01) |
| ***F25D 23/02*** | (2006.01) |
| ***F25D 23/08*** | (2006.01) |
| ***F25D 23/12*** | (2006.01) |

(52) U.S. Cl.
CPC ..... *F25D 23/12* (2013.01); *F25D 21/04* (2013.01); *F25D 23/028* (2013.01); *F25D 2400/02* (2013.01)

(58) Field of Classification Search
CPC ..... F25D 2400/02; F25D 2321/1412; F25D 21/14; F25D 19/02; F25D 11/00; F25D 21/08; F25D 23/062; F25D 2317/0651; F25D 2317/0661; F25D 2321/141; F25D 2321/1413
See application file for complete search history.

(56) References Cited

U.S. PATENT DOCUMENTS

| | | | | |
|---|---|---|---|---|
| 2020/0200466 | A1 | 6/2020 | Hwang et al. | |
| 2021/0131717 | A1* | 5/2021 | Ko et al. | F25D 17/065 |
| 2022/0120493 | A1* | 4/2022 | Je et al. | F25D 23/12 |

FOREIGN PATENT DOCUMENTS

| | | | | |
|---|---|---|---|---|
| JP | S57-85178 | | 5/1982 | |
| JP | 2006-200765 | | 8/2006 | |
| JP | 2007-085622 | | 4/2007 | |
| KR | 2003-0027367 | | 4/2003 | |
| KR | 20110085595 A | * | 7/2011 | F25D 23/069 |
| KR | 10-2020-0076466 | | 6/2020 | |
| KR | 10-2021-0024925 | | 3/2021 | |
| WO | WO 2021/086124 | | 5/2021 | |

OTHER PUBLICATIONS

KR 20110085595 A Translation (Year: 2011).*
Extended European Search Report dated Mar. 28, 2025, issued in Application No. 22837992.1.
International Search Report dated Oct. 21, 2022 issued in Application No. PCT/KR2022/009799.

* cited by examiner

STOREHOUSE

CROSS-REFERENCE TO RELATED PATENT APPLICATIONS

This application is a U.S. National Stage Application under 35 U.S.C. § 371 of PCT Application No. PCT/KR2022/009799, filed Jul. 6, 2022, which claims priority to Korean Patent Application No. 10-2021-0089691, filed Jul. 8, 2021, whose entire disclosures are hereby incorporated by reference.

TECHNICAL FIELD

The present disclosure relates to a storehouse.

BACKGROUND ART

A storehouse may include a storage space for storing goods. Examples of the storehouse may include a refrigerator.

The refrigerator is an apparatus that cools objects to be cooled (e.g., food, drugs, and cosmetics) (hereinafter referred to as food for convenience), or stores food at low temperature so as to prevent spoilage and deterioration. The refrigerator includes a storage space in which food is stored, and a refrigeration cycle part that cools the storage space.

The refrigeration cycle part may include a compressor, a condenser, an expansion mechanism, and an evaporator, through which a refrigerant circulates.

A refrigerator according to the related art may include an outer case, and an inner case located inside the outer case and having an opened front side. Such a refrigerator may include a cold air discharge duct disposed inside the inner case to partition the inside of the inner case into a storage space and a heat exchange space. For example, the storage space may be defined in front of the cold air discharge duct, and the heat exchange space may be defined in the rear of the cold air discharge duct. An evaporator and an evaporating fan may be disposed in the heat exchange space.

The refrigerator may have a separate machine space defined outside the inner case. A compressor, a condenser, and a condensing fan may be disposed in the machine space. The compressor in the machine space may be connected to the evaporator in the heat exchange space through a refrigerant pipe.

The storage space may be provided with a withdrawable drawer. A plurality of the drawers may be provided in a vertical direction.

However, the refrigerator according to the related art as described above has the following problems.

First, the compressor in the machine space and the evaporator in the inner case are disposed in spaces separated from each other and are connected to each other by the refrigerant pipe. Therefore, when it is necessary to repair the refrigeration cycle part, it is inconvenient to take out food stored in the refrigerator so as to check and repair failure.

Second, since the evaporator has to be integrally formed inside the refrigerator body and the evaporator has to be fixed to the refrigerator body by welding or the like, there is an inconvenience in manufacturing the refrigerator. In addition, when the evaporator defrosts, heat exchange with the storage space increases the internal temperature of the refrigerator.

Third, since the heat exchange space is disposed in the rear of the storage space, the width of the rear wall of the refrigerator body in the front-and-rear direction increases as much as the size of the heat exchange space. Therefore, the volume of the storage space is reduced as much.

In order to solve these problems, a refrigerator including a cooling module that integrally configures a heat absorbing portion and a heat dissipating portion has been proposed.

DISCLOSURE

Technical Problem

An embodiment of the present disclosure aims to provide a storehouse in which a first storage space configured to provide a space in which goods are stored is fluidly connected to a second storage space configured to provide a space in which a first heat exchanger is accommodated.

An embodiment of the present disclosure aims to provide a storehouse in which a sealing member is provided at a portion where a second storage space and a first storage space are in contact with each other, thereby preventing a fluid in the second storage space from leaking out to the outside.

An embodiment of the present disclosure aims to provide a storehouse in which a heat source is provided in the inside of a second wall of a second storage space or in the vicinity of the second wall, thereby preventing dew formation due to temperature difference around the first and second storage spaces.

An embodiment of the present disclosure aims to provide a storehouse in which a heat source is provided in the vicinity of a portion where a first wall is in contact with a door, thereby reducing dew generated in the portion where the first wall is in contact with the door.

An embodiment of the present invention aims to provide a storehouse including a heat source disposed on at least two walls among a plurality of walls constituting the second wall.

Technical Solution

The present disclosure may be a storehouse including a first storage space configured to provide a space in which goods are stored within a predetermined temperature or a predetermined temperature range and a second storage space configured to provide a space in which a first heat exchanger is accommodated.

The storehouse may include a third storage space configured to provide a space in which a second heat exchanger is accommodated.

The storehouse may include a first wall defining at least a part of the first storage space.

The storehouse may include a second wall defining at least a part of the second storage space.

The storehouse may include a third wall defining at least a part of the third storage space.

The storehouse may include a sealing member provided in a portion where the first storage space and the second storage space are in contact with each other.

The second storage space may be fluidly connected to the first storage space.

The storehouse may include a heat source provided in the inside of the second wall or in the vicinity of the second wall. The heat source may remove or reduce dew that may be generated on the second wall.

The heat source may reduce dew that is formed in a portion where the first wall is in contact with the second wall.

The heat source may reduce dew that is formed in a portion of the second wall that faces the second heat exchanger.

The heat source may include a heater provided as a separate component or a refrigerant pipe through which a high-temperature refrigerant flows.

The refrigerant pipe may be heated by a separate heater.

The refrigerant pipe may include a first portion connected to a condenser configured to condense the refrigerant at a high temperature and a second portion provided in the second wall. The second portion may remove or reduce dew that is formed on the second wall.

The refrigerant pipe may include a third portion provided in the first wall.

The three portions may be provided in the vicinity of the portion where the first wall is in contact with the door. The third portion may reduce dew that is formed in a portion where the first wall is in contact with the door.

The heat source may be provided in the vicinity of the sealing member.

The heat source may have a shape corresponding to the sealing member.

The heat source may be provided between the first storage space and the second storage space.

The heat source may be provided in a portion where the first storage space and the second storage space are coupled to each other.

The second wall may include a plurality of walls extending in different directions.

The heat source may be disposed on at least two of the plurality of walls.

The heat source may be disposed to surround the edge formed by the plurality of walls that meet each other.

The heat source may be provided in at least one of a wall that faces the second heat exchanger and a wall that partitions the second storage space and the third storage space.

The second wall may include a plurality of walls, and the heat source may be arranged in rows more than N rows in some of the plurality of walls, and may be arranged in N rows in others of the plurality of walls (where may be greater than or equal to 0).

Some of the plurality of walls may be provided as at least one of a wall that faces the second heat exchanger and a wall that partitions the second storage space and the third storage space.

In one aspect of the present disclosure, a storehouse may include a first storage space configured to provide a space in which goods are stored within a predetermined temperature or a predetermined temperature range and a second storage space configured to provide a space in which a first heat exchanger is accommodated.

The storehouse may include a third storage space configured to provide a space in which a second heat exchanger is accommodated.

The storehouse may include a sealing member provided in a portion where the first storage space and the second storage space are in contact with each other.

The storehouse may include a heat source provided in the inside of the second wall or in the vicinity of the second wall.

The heat source may include a heater provided as a separate component.

The heat source may include a refrigerant pipe through which a high-temperature refrigerant flows.

The refrigerant pipe may be heated by a separate heater.

The refrigerant pipe may include a first pipe connected to an outlet side of the second heat exchanger or connected to an outlet side of a compressor connected to an inlet side of the second heat exchanger, and a second pipe provided in the second wall.

The refrigerant pipe may include a third portion provided in the first wall.

The third pipe may be provided in the vicinity of a portion where the first wall is in contact with a door.

The heat source may be provided in the vicinity of the sealing member.

The heat source may have a shape corresponding to the sealing member.

In another aspect of the present disclosure, a storehouse may include a first storage space configured to provide a space in which goods are stored within a predetermined temperature or a predetermined temperature range and a second storage space configured to provide a space in which a first heat exchanger is accommodated.

The storehouse may include a first wall defining at least a part of the first storage space, a second wall defining at least a part of the second storage space, and a heat source provided in the inside of the second wall or in the vicinity of the second wall.

The heat source may be provided between the first storage space and the second storage space.

The heat source may be provided in a portion where the first storage space and the second storage space are coupled to each other.

The second wall may include a plurality of walls extending in different directions, and the heat source may be disposed in at least two of the plurality of walls.

The heat source may be disposed to surround the edge formed by the plurality of walls that meet each other.

In further another aspect of the present disclosure, a storehouse may include a first storage space configured to provide a space in which goods are stored within a predetermined temperature or a predetermined temperature range and a second storage space configured to provide a space in which a first heat exchanger is accommodated.

The storehouse may include a third storage space configured to provide a space in which a second heat exchanger is accommodated.

The storehouse may include a first wall defining at least a part of the first storage space, a second wall defining at least a part of the second storage space, and a heat source provided in the inside of the second wall or in the vicinity of the second wall.

The heat source may be provided in at least one of a wall that faces the second heat exchanger and a wall that partitions the second storage space and the third storage space.

The second wall may include a plurality of walls, and the heat source may be arranged in rows more than N rows in some of the plurality of walls, and may be arranged in N rows in others of the plurality of walls (where N is greater than or equal to 0).

Some of the plurality of walls may be provided as at least one of a wall that faces the second heat exchanger and a wall that partitions the second storage space and the third storage space.

Advantageous Effects

According to an embodiment of the present disclosure, first and second storage spaces are fluidly connected to each other. Therefore, the fluid heat-exchanged in a first heat exchanger may be easily supplied to the first storage space, and the fluid in the first storage space may be easily returned to the second storage space.

According to an embodiment of the present disclosure, a sealing member is provided at a portion where a second storage space and a first storage space are in contact with each other, thereby preventing a fluid in the second storage space from leaking out to the outside.

According to an embodiment of the present disclosure, a heat source is provided in the inside of a second wall of a second storage space or in the vicinity of the second wall, thereby preventing dew formation due to temperature difference around the first and second storage spaces.

According to an embodiment of the present disclosure, a heat source is provided in the vicinity of a portion where a first wall is in contact with a door, thereby reducing dew generated in the portion where the first wall is in contact with the door.

According to an embodiment of the present invention, a storehouse includes a heat source disposed on at least two walls among a plurality of walls constituting the second wall, thereby improving operation performance of the storehouse.

MODE FOR INVENTION

Figure 1:
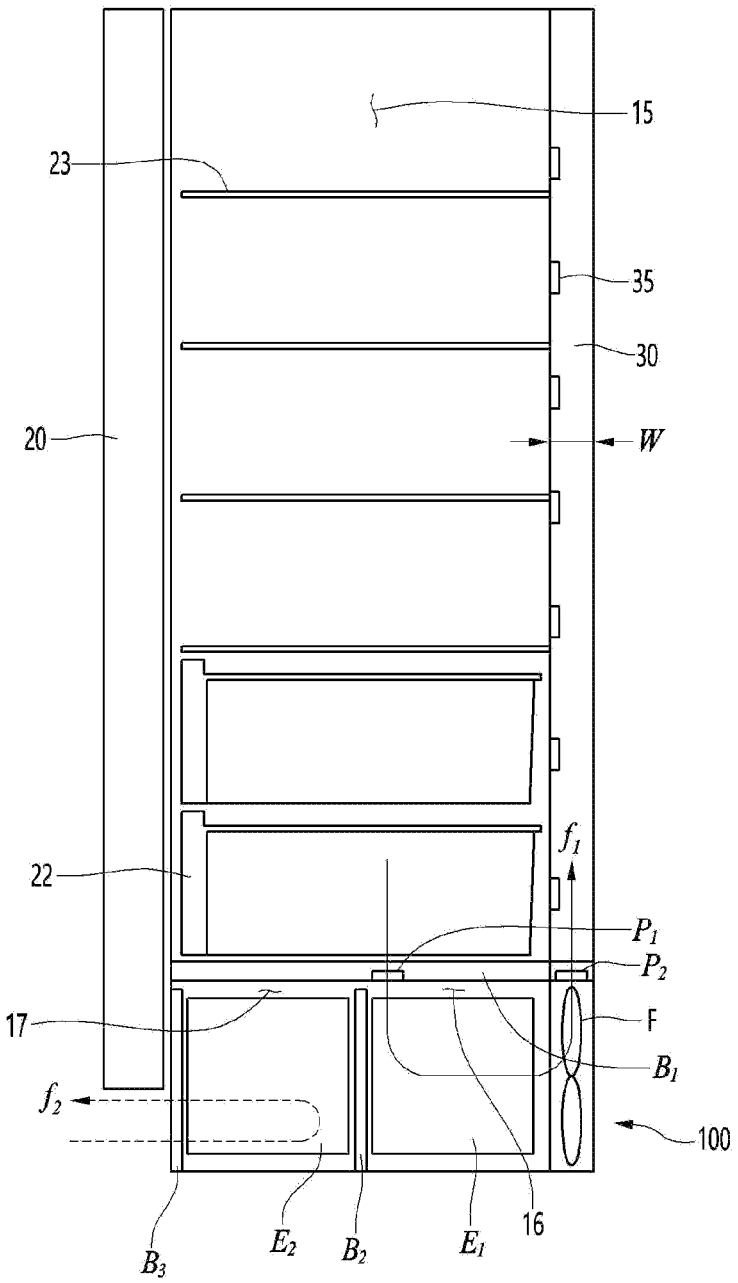
FIG. 1 is a schematic diagram of a storehouse according to an embodiment of the present disclosure.

The present disclosure may be a storehouse including a first storage space configured to provide a space in which goods are stored within a predetermined temperature or a predetermined temperature range and a second storage space configured to provide a space in which a first heat exchanger is accommodated.

Examples of the storehouse may be a refrigerator, a heating cabinet, and the like.

Examples of the goods may include food, medical products, and the like.

The storehouse may include a third storage space configured to provide a space in which a second heat exchanger is accommodated.

The storehouse may include a first wall defining at least a part of the first storage space.

The storehouse may include a second wall defining at least a part of the second storage space.

The storehouse may include a third wall defining at least a part of the third storage space.

The second storage space may be fluidly connected to the first storage space.

The first heat exchanger may be a heat exchanger that is fluidly connected to an inner space of the first storage space to exchange heat with a fluid present in the inner space.

The second heat exchanger may be a heat exchanger that is fluidly connected to an outer space of the first storage space to exchange heat with a fluid present in the outer space.

Examples of a heat exchange method of the heat exchanger may include direct heat exchange by conduction or indirect heat exchange by convection or radiation.

An example of the heat exchanger may be a heat absorbing portion, a cooling power generator, and a heat exchanger provided as a cold source. An example of the cold source may be an evaporator, a heat absorbing surface of a thermoelectric element as a heat absorbing portion of a thermoelectric module, or a cold sink connected to the heat absorbing surface.

Another example of the heat exchanger may be a heat dissipating portion, a heat power generator, and a heat exchanger provided as a heat source. Examples of the heat source may be a condenser, a heat generating surface of a thermoelectric element as a heat dissipating portion of a thermoelectric module, or a heat sink connected to the heat generating surface. Examples of the fluid may include a liquid or a gas, such as air, water, and a refrigerant.

The first wall may be provided to separate the inner space of the first storage space from the outer space of the first storage space.

The second wall may be provided to separate the inner space of the second storage space from the outer space of the second storage space.

The third wall may be provided to separate the inner space of the third storage space from the outer space of the third storage space.

The first wall may be provided to separate the first storage space from at least one of the second storage space and the third storage space.

The second wall may be provided to separate the second storage space from at least one of the first storage space and the third storage space.

The third wall may be provided to separate the third storage space from at least one of the first storage space and the second storage space.

The wall provided to separate the first storage space from the second storage space may be provided as a common wall between the first wall and the second wall.

The wall provided to separate the second storage space from the third storage space may be provided as a common wall between the second wall and the third wall.

The wall provided to separate the first storage space from the third storage space may be provided as a common wall between the first wall and the third wall.

The wall may be provided as one wall including a plurality of layers. A plurality of walls may be connected in a longitudinal direction and provided as one wall.

Fluidly connecting the first space and the second space may be defined as follows: the fluid located in one of the first space and the second space is movable to the other one of the first space and the second space.

The storehouse may include a door provided to open or close the first storage space. The door may be provided to cover at least a part of the second storage space. The door may be provided to cover at least a part of the third storage space.

In the present disclosure, when an object is divided into three equal portions based on the longitudinal direction of the object, the central portion of the object may be defined as the position located in the center among the three equally-divided portions. The peripheral portion of the object may be defined as a portion located to the left or right of the central portion among the three equally-divided portions. The peripheral portion of the object may include a surface in contact with the central portion and a surface opposite thereto. The opposite surface may be defined as a border or an edge of the object.

The storehouse may include a fluid generator disposed on a path through which the fluid flows so that the fluid in the inner space of the storage space flows to the outer space of the storage space.

The fluid generator may include a fluid generator for the second storage space disposed on a path through which the fluid flows so that the fluid in the second storage space flows to the outer space of the second storage space.

The fluid generator may include a fluid generator for the third storage space disposed on a path through which the fluid flows so that the fluid in the third storage space flows to the outer space of the third storage space.

Examples of the fluid generator may include a fan allowing air to flow, a pump allowing water to flow, a compressor allowing a refrigerant to flow, and the like.

A first passage, through which the fluid flows, may be provided inside of the first wall or in the vicinity of the first wall.

Examples of the first passage may be a through hole defined to pass through the inside of the wall, a duct provided inside the wall, or a duct provided outside the wall.

The first passage may include an inlet passage configured to guide the fluid in the outer space of the first storage space to flow to the inner space of the first storage space.

The first passage may include an outlet passage configured to guide the fluid in the inner space of the first storage space to flow to the outer space of the first storage space.

The first passage may include an inlet passage configured to guide the fluid heat-exchanged in the outer space of the first storage space to flow to the inside of the first storage space.

The first passage may include an outlet passage configured to guide the fluid heat-exchanged with goods in the inner space of the first storage space to flow to the outer space of the first storage space.

The inlet passage may be provided in at least one of a front wall, a rear wall, a side wall, an upper wall, and a lower wall of the first storage space.

The outlet passage may be provided in at least one of the front wall, the rear wall, the side wall, the upper wall, and the lower wall of the first storage space.

For example, the inlet passage may be provided as a through hole or a duct disposed in the rear wall of the first storage space.

For example, the outlet passage may be provided as a through hole or a duct disposed in the lower wall of the first storage space.

A second passage, through which the fluid flows, may be provided inside of the second wall or in the vicinity of the second wall.

Examples of the second passage may be a through hole defined to pass through the inside of the wall, a duct provided inside the wall, or a duct provided outside the wall.

The second passage may include an inlet passage configured to guide the fluid in the outer space of the second storage space to flow to the inner space of the second storage space.

The second passage may include an outlet passage configured to guide the fluid in the inner space of the second storage space to flow to the outer space of the second storage space.

The second passage may include an inlet passage configured to guide the fluid heat-exchanged in the outer space of the second storage space to flow to the inside of the second storage space.

The second passage may include an outlet passage configured to guide the fluid heat-exchanged with the first heat exchanger to flow to the outer space of the second storage space.

The inlet passage may be provided in at least one of a front wall, a rear wall, a side wall, an upper wall, and a lower wall of the second storage space.

For example, the inlet passage may be provided as a through hole or a duct disposed in the upper wall of the second storage space.

For example, the outlet passage may be provided as a through hole or a duct disposed in the upper wall of the second storage space.

A third passage, through which the fluid flows, may be provided inside of the third wall or in the vicinity of the third wall.

Examples of the third passage may be a through hole defined to pass through the inside of the wall, a duct provided inside the wall, or a duct provided outside the wall.

The third passage may include an inlet passage configured to guide the fluid in the outer space of the third storage space to flow to the inner space of the third storage space.

The third passage may include an outlet passage configured to guide the fluid in the inner space of the third storage space to flow to the outer space of the third storage space.

The third passage may include an inlet passage configured to guide the fluid heat-exchanged in the outer space of the third storage space to flow to the inside of the third storage space.

The third passage may include an outlet passage configured to guide the fluid heat-exchanged with the second heat exchanger to flow to the outer space of the third storage space.

The inlet passage may be provided in at least one of a front wall, a rear wall, a side wall, an upper wall, and a lower wall of the third storage space.

The outlet passage may be provided in at least one of the front wall, the rear wall, the side wall, the upper wall, and the lower wall of the third storage space.

For example, the inlet passage may be provided as a through hole or a duct disposed in the front wall of the third storage space.

For example, the outlet passage may be provided as a through hole or a duct disposed in the front wall of the third storage space.

The fluid in the inner space of the first storage space may be fluidly connected to one of the second storage space and the third storage space.

For example, the fluid in the inner space of the first storage space may flow to the inner space of the second storage space via the second passage.

The fluid in the inner space of the second storage space may flow to the inner space of the first storage space via the first passage.

The fluid in the outer space of the storehouse may be fluidly connected to one of the second storage space and the third storage space.

For example, the fluid in the inner space of the third storage space may flow to the outer space of the third storage space via the third passage.

The fluid in the outer space of the third storage space may flow to the inner space of the third storage space via the third passage.

The second storage space may be disposed in the outer space of the first storage space together with the third storage space.

At least a part of the second wall may be coupled to at least a part of the third wall and then disposed in the outer space of the first storage space.

At least a part of the second wall may be integrally provided with at least a part of the third wall and then disposed in the outer space of the first storage space.

At least a part of the second wall may extend so as to be provided as at least a part of the third wall.

At least a part of the third wall may extend so as to be provided as at least a part of the second wall.

At least a part of the second wall may extend to support at least a part of the third wall.

At least a part of the third wall may extend to support at least a part of the second wall.

The portion from which the second wall extends may be provided on at least one of the front wall, the rear wall, the side wall, the upper wall, and the rear wall of the second storage space.

The portion from which the third wall extends may be provided on at least one of the front wall, the rear wall, the side wall, the upper wall, and the rear wall of the third storage space.

For example, the portion from which the second wall extends may be provided on the lower wall of the second storage space.

As another example, the portion from which the third wall extends may be provided on the lower wall of the third storage space.

The first heat exchanger acting as a cold source may be provided in the second storage space.

A heat source that removes frost generated in the first heat exchanger may be disposed in the vicinity of the first heat exchanger.

For example, the heat source may be a defrosting heat source.

The first heat exchanger acting as a heat source may be provided in the second storage space.

A cold source that removes steam generated in the first heat exchanger may be disposed in the vicinity of the first heat exchanger.

For example, the cold source may be a steam removing cold source.

The second wall may include a through hole through which the second storage space is fluidly connected to the first storage space.

The second wall may include a portion having a higher degree of insulation than the third wall.

The second wall may be a wall that partitions the first storage space and the second storage space.

In this manner, it is possible to reduce the transfer of the heat of the defrosting heat source or the cold of the steam removing cold source to the first storage space or the outer space of the second storage space.

The second wall may include a through hole through which the second storage space is fluidly connected to the first passage.

The second wall may include a portion having a higher degree of insulation than the wall defining the first passage. In this manner, it is possible to reduce the transfer of the heat of the defrosting heat source or the cold of the steam removing cold source to the first storage space or the outer space of the second storage space.

The first storage space may include a plurality of storage compartments. The first storage space may include at least one of a partition wall, a drawer, and a shelf so as to form the plurality of storage compartments. A passage through which a fluid flows may be provided between the plurality of storage compartments.

An embodiment capable of reducing heat exchange between the defrosting heat source or the steam removing cold source and some of the plurality of storage compartments is as follows. In this manner, when the storehouse is provided as a refrigerator, cooling efficiency may be improved, and when the storehouse is provided as a heating cabinet, heating efficiency may be improved.

First, one of the plurality of storage compartments may include a surface that faces the second storage space and a surface that faces another one of the plurality of storage compartments.

One of the plurality of storage compartments may be disposed between the second storage space and another one of the plurality of storage compartments. In this case, one of the plurality of storage compartments may be provided as an insulating space for reducing heat transfer between another one of the plurality of storage compartments and the defrosting heat source or the steam removing cold source.

Second, one of the plurality of storage compartments may include both the through hole through which the fluid flows into the second storage space and the through hole through which the fluid flows out from the second storage space, and another one of the plurality of storage compartments may include only one of the through hole through which the fluid flows into the second storage space and the through hole through which the fluid flows out from the second storage space.

For example, the through hole of one of the plurality of storage compartments may be provided inside of the second wall or in the vicinity of the second wall. The through hole of another one of the plurality of storage compartments may be provided inside of the first wall or in the vicinity of the first wall.

Third, only one of the plurality of storage compartments may be disposed to face the second storage space or may be disposed adjacent to the second storage space. For example, one of the plurality of storage compartments may be provided in at least one of the uppermost end, the lowermost end, the rightmost end, the leftmost end, the rearmost end, and the foremost end of the second storage space.

Fourth, the fluid inside the first storage compartment among the plurality of storage compartments may be provided to flow into the second storage space without passing through another one of the plurality of storage compartments, and the fluid inside the second storage compartment among the plurality of storage compartments may be provided to flow into the second storage space through another one of the plurality of storage compartments.

An embodiment in which the second storage space and the third storage space are disposed is as follows.

First, the first storage space may include a portion extending in a horizontal direction, i.e., X-axis direction, and a portion extending in a vertical direction, i.e., Y-axis direction. The second storage space may be disposed adjacent to the third storage space in the X-axis direction. A wall that partitions the second storage space and the third storage space may include a portion extending in the Y-axis direction.

Second, the first storage space may include a portion extending in a horizontal direction, i.e., X-axis direction, and a portion extending in a vertical direction, i.e., Y-axis direction. The second storage space may be disposed adjacent to the third storage space in the Y-axis direction. A wall that partitions the second storage space and the third storage space may include a portion extending in the X-axis direction.

An embodiment in which the first heat exchanger and the fluid generator are disposed is as follows.

First, the first heat exchanger may include a long portion extending in the X-axis direction and a short portion extending in the Y-axis direction, and the fluid generator may be disposed such that a length in the X-axis direction is longer than a length in the Y-axis direction.

The fluid generator may be disposed spaced apart from the first heat exchanger in the Y-axis direction.

For example, the fluid generator may be disposed above or below the first heat exchanger.

The fluid generator may be disposed to overlap the first heat exchanger in the Y-axis direction. The fluid generator may be disposed in an inclined direction with respect to the ground.

A suction hole through which the fluid is sucked into the first heat exchanger may be disposed to be lower than a discharge hole through which the fluid heat-exchanged with the first heat exchanger is discharged.

In this manner, the effect of reducing the flow loss of the fluid generator may be obtained.

Second, the first heat exchanger may include a long portion extending in the X-axis direction and a short portion extending in the Y-axis direction, and the fluid generator may be disposed such that a length in the X-axis direction is shorter than a length in the Y-axis direction.

The fluid generator may be disposed spaced apart from the first heat exchanger in the X-axis direction. For example, the fluid generator may be disposed in the front or rear of the first heat exchanger. The fluid generator may be disposed to overlap the first heat exchanger in the X-axis direction.

The storehouse may include a fluid generator for the second storage space. An embodiment of the arrangement of the fluid generator is as follows.

First, an imaginary line extending from the center of the fluid generator toward the first heat exchanger may be disposed to pass through the first heat exchanger. The center of the fluid generator may be defined as at least one of the center of gravity, the center of mass, the center of volume, and the center of rotation of the fluid generator. The imaginary line may be disposed to pass through the central portion of the first heat exchanger. The imaginary line may be disposed to pass through the peripheral portion of the first heat exchanger.

Second, an imaginary line extending from the center of the fluid generator toward the first storage space may be disposed to pass through the first storage space. An imaginary line extending from the center of the fluid generator toward the first heat exchanger may be disposed so as not to overlap the first heat exchanger.

Third, the fluid generator may be disposed inside the second storage space. In this case, the first heat exchanger and the fluid generator may be disposed inside the second storage space, which may be advantageous in designing a module for the second storage space. At least a part of the second passage may be provided to be exposed to the second storage space.

Fourth, the fluid generator may be disposed in at least one of the inside of the first passage and the inside of the second passage. In this case, since the distance between the first heat exchanger and the fluid generator may be separated, there is an advantage that can reduce a dead zone that may occur in the flow passage of the fluid. The passage on which the fluid generator is disposed may include a portion protruding toward the first storage space. Therefore, the volume of the first storage space may be increased. The fluid generator may be disposed inside the protruding portion.

Fifth, at least a part of the fluid generator may be provided to form at least a part of the first passage or at least a part of the second passage. For example, the fluid generator may include a fan and a fan housing. The fan housing may define at least a part of the first passage, or the fan housing may define at least a part of the second passage.

Hereinafter, some embodiments of the present disclosure will be described in detail with reference to exemplary drawings. In assigning reference numerals to the components of the drawings, it should be noted that the same components are denoted by the same reference numerals as much as possible even though the components are shown in different drawings. In addition, in describing the embodiments of the present disclosure, if the detailed description of the relevant known functions or configurations is determined to unnecessarily obscure the gist of the present disclosure, the detailed description thereof is omitted.

In addition, the terms, such as "first", "second", "A", "B", "(a)", or "(b)" may be used herein to describe the components of the present disclosure. These terms are only for distinguishing one component from another, and the essence, order, or sequence of the components is not limited by the terms. When one component is described as being "connected", "coupled", or "linked" to another component, the component may be directly connected or coupled to the other component, but it should be understood that another component may be "connected", "coupled" or "linked" between components.

FIG. 1 is a schematic diagram of a storehouse according to an embodiment of the present disclosure.

Referring to FIG. 1, a storehouse 1 according to an embodiment of the present disclosure includes a storehouse body 10 defining a first storage space 15.

The storehouse may be configured as a refrigerator or a heating cabinet.

The first storage space 15 may provide a space in which goods are stored within a predetermined temperature or a predetermined temperature range.

The storehouse 1 may include a first wall defining at least a part of the first storage space 15.

The first wall may include at least one of a front wall, a rear wall, a side wall, an upper wall, and a lower wall.

The first wall may include a plurality of walls.

For example, the storehouse body 10 may have a hexahedral shape with an opened front side. However, the shape of the storehouse body 10 is not limited thereto.

The storehouse body 10 may include a body outer case 11 (referring to FIG. 3), a body inner case 12 (referring to FIG. 3) assembled inside the body outer case 11, and a body insulating material 13 (referring to FIG. 3) for insulation provided between the body outer case 11 and the body inner case 12

The storehouse 1 may further include a door 20 capable of opening or closing the first storage space 15. The door 20 may be movably provided in front of the storehouse body 10.

A shelf 23 on which food is supported may be provided in the first storage space 15. For example, a plurality of shelves 23 may be vertically spaced apart from each other in the first storage space 15.

A drawer 22 that accommodates food may be provided in the first storage space 15. The drawer 22 is provided to be withdrawable. The drawer 22 may be provided in plurality. For example, the plurality of drawers 22 may be vertically spaced apart from each other in the first storage space 15.

A plurality of storage compartments may be defined by the plurality of shelves 23 or the plurality of drawers 22.

A duct 30 for supplying a fluid to the first storage space 15 may be provided on the rear wall of the first storage space 15.

The duct 30 may constitute a first passage through which the fluid flows, the first passage being provided inside of the first wall or in the vicinity of the first wall defining the first storage space 15.

The duct 30 may be located behind the plurality of drawers 22.

The fluid heat-exchanged in a second storage space 16 flows through the duct 30, and a duct discharge hole 35 through which the fluid is discharged to the first storage space 15 may be defined on the front surface of the duct 30.

A plurality of duct discharge holes 35 may be defined. The plurality of duct discharge holes 35 may be disposed vertically.

The duct 30 extends in the vertical direction and is configured to have a constant width w in the front-and-rear direction. Due to the duct 30 having a constant width, the plurality of drawers 22 may be disposed vertically with the same size and shape.

The storehouse 1 may include the second storage space 16 providing a space in which a first heat exchanger E1 is accommodated.

The second storage space 16 may be partitioned from the first storage space 15 by a partition wall B1.

The partition wall B1 may constitute at least a part of the first storage space 15.

The partition wall B1 may constitute at least a part of the second storage space 16.

The partition wall B1 may constitute at least a part of the third storage space 17.

The storehouse 1 may include a third storage space 17 providing a space in which a second heat exchanger E2 is accommodated.

The first heat exchanger E1 and the second heat exchanger E2 may be separated by an insulating wall B2.

The insulating wall B2 may constitute at least a part of the second storage space 16.

The insulating wall B2 may constitute at least a part of the third storage space 17.

The storehouse 1 may include a heat exchange device 100. The heat exchange device 100 includes the first heat exchanger E1 and the second heat exchanger E2.

For example, the heat exchange device 100 may be detachably disposed at the lower portion of the storehouse body 10. However, the present disclosure is not limited thereto, and the first heat exchanger E1 and the second heat exchanger E2 may be provided separately from each other.

The second heat exchanger E2 may be disposed in the front portion of the heat exchange device 100, and the first heat exchanger E1 may be disposed in the rear portion of the heat exchange device 100.

The insulating wall B2 may be located between the first heat exchanger E1 and the second heat exchanger E2.

Two independent flows may be generated in the heat exchange device 100. The two independent flows may include a first flow f1 circulating through the first and second storage spaces 15 and 16 and a second flow f2 passing through the inside and the outside of the third storage space 17.

The heat exchange device 100 may further include a cover B3 through which the second flow f2 passes.

The cover B3 may define at least a part of the third storage space 17.

The cover B3 may include a cover inlet portion through which the fluid outside the third storage space 17 is guided to flow into the third storage space 17, and a cover discharge portion through which the fluid heat-exchanged in the third storage space 17 is discharged.

For example, outside air may be introduced from the front side to the third storage space 17 through the cover inlet portion, and may be discharged from the third storage space 17 to the front side through the cover discharge portion. However, the direction in which the outside air is introduced and discharged is not limited thereto.

The second flow f2 may be generated by a fluid generator, for example, a second fan, and may circulate through the cover inlet portion of the cover B3, the third storage space 17, and the cover discharge portion of the cover B3.

At least a part of the cover B3 may be shielded by the door 20. For example, the lower end portion of the door 20 may be formed at a position lower than the upper end portion of the cover B3.

As another example, the cover B3 may be located under the door 20. The upper end portion of the cover B3 may be formed at a position corresponding to the lower end portion of the door 20 or a position lower than the lower end portion of the door 20.

However, the relative positions of the cover B3 and the door 20 may not be limited thereto.

An inlet portion P1 through which the fluid in the first storage space 15 is introduced into the second storage space 16 and an outlet portion P2 through which the fluid heat-exchanged in the second storage space 16 is discharged to the duct 30 may be formed in the partition wall B1.

For example, the inlet portion P1 may be disposed above the front portion of the second storage space 16, and the outlet portion P2 may be disposed above the rear portion of the second storage space 16.

The first flow f1 may circulate through the inlet portion P1, the second storage space 16, and the outlet portion P2.

For example, the first heat exchanger E1 may include an evaporator.

For example, the second heat exchanger E2 may include a condenser.

The storehouse 1 may include a fluid generator disposed downstream of the first heat exchanger E1 to generate a flow. For example, the fluid generator may include a first fan F.

The first fan F may be disposed inside the second storage space 16, inside the partition wall B1, or inside the first storage space 15.

For example, the first fan F may be disposed above the first heat exchanger E1. However, the location of the first fan F is not limited thereto, and the first fan F may be provided at another location if the first fan F is disposed on the outlet side of the first heat exchanger E1.

The first fan F may be fluidly connected to the inlet portion P1 and the outlet portion P2. For example, based on the passage of the fluid, the first fan F may be provided between the inlet portion P1 and the outlet portion P2.

The fluid, which is introduced into the second storage space 16 through the inlet portion P1, may pass through the first heat exchanger E1 and the first fan F and then circulate to the duct 30 through the outlet portion P2.

Figure 2:
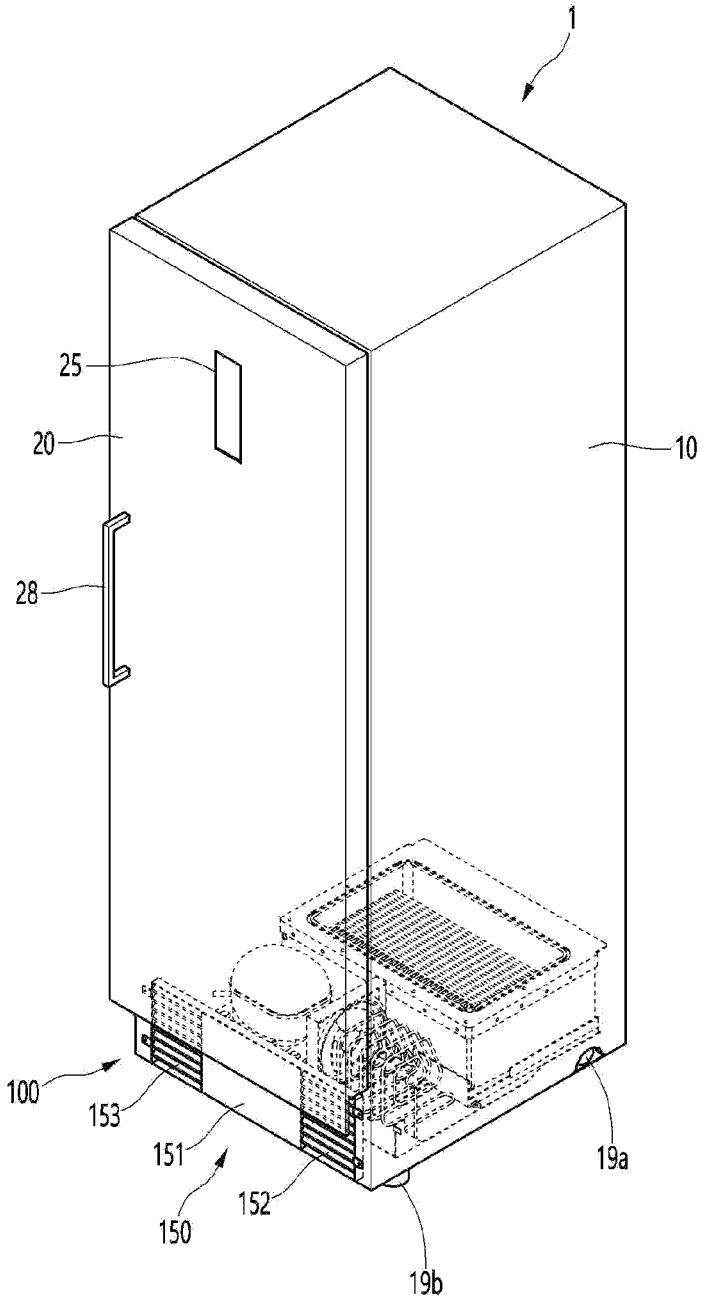
FIG. 2 is a front perspective view of the storehouse according to an embodiment of the present disclosure.
Figure 3:
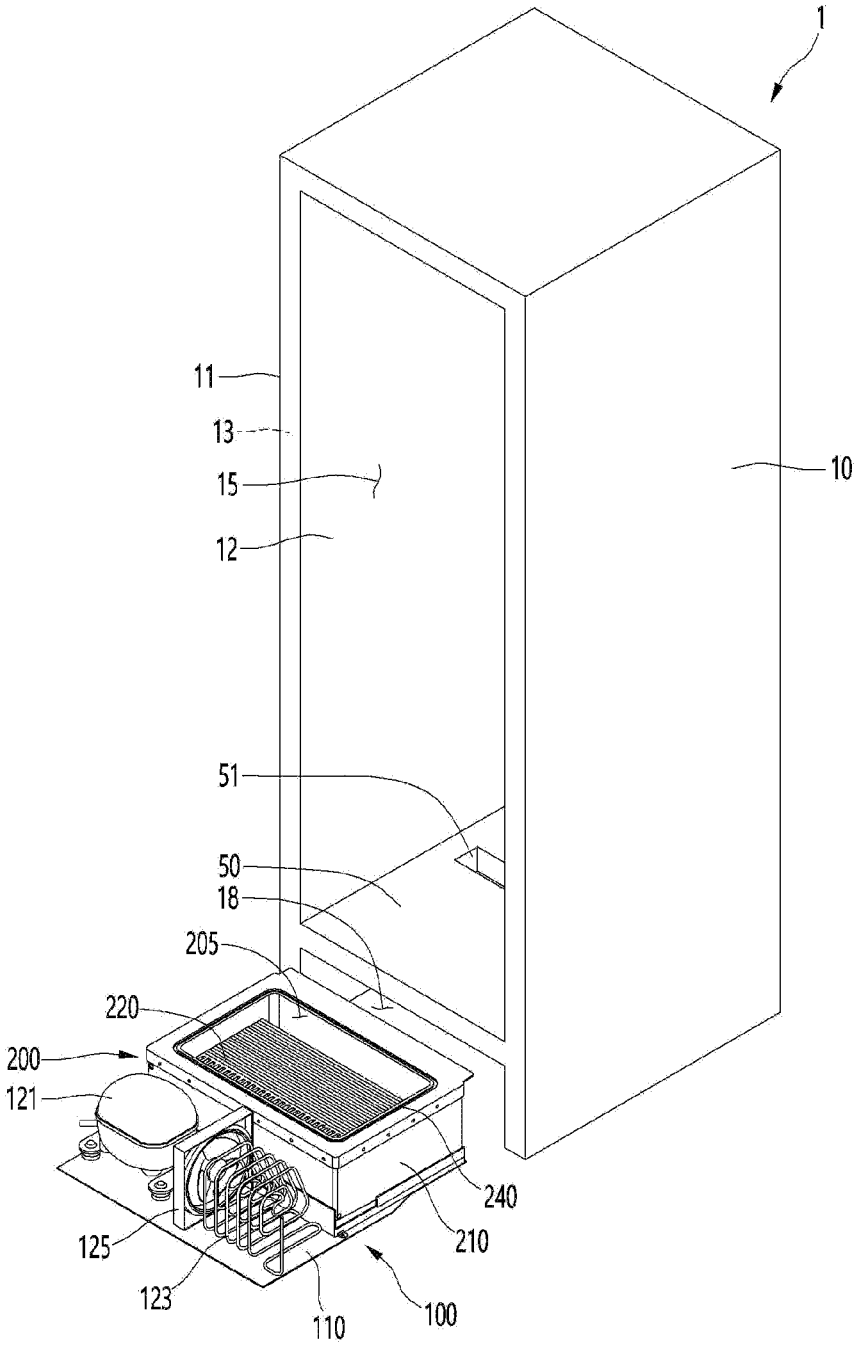
FIG. 3 is an exploded perspective view of a storehouse body and a heat exchange device according to an embodiment of the present disclosure.
Figure 4:
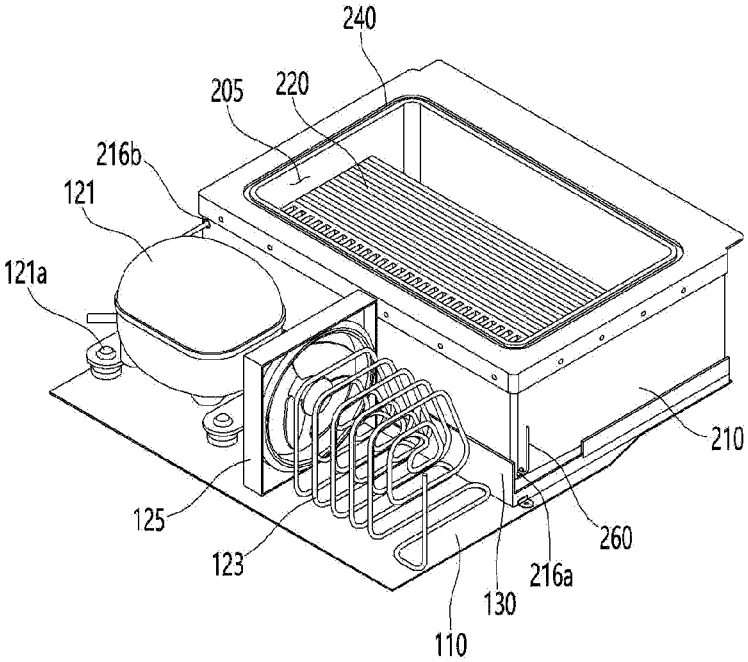
FIG. 4 is a perspective view of the heat exchange device according to an embodiment of the present disclosure.

FIG. 2 is a front perspective view of the storehouse according to an embodiment of the present disclosure, FIG. 3 is an exploded perspective view of the storehouse body and the heat exchange device according to an embodiment of the present disclosure, and FIG. 4 is a perspective view of the heat exchange device according to an embodiment of the present disclosure.

Referring to FIGS. 2 to 4, the storehouse 1 according to an embodiment of the present disclosure may include the storehouse body 10 defining the first storage space 15, and the door 20 provided in front of the storehouse body 10 to open or close the first storage space 15.

The door 20 may include a door handle 28 that allows a user to grip, and a display unit 25 that displays storehouse operation information.

The storehouse 1 may further include a heat exchange device 100 including a refrigeration cycle part.

The refrigeration cycle part may include a first heat exchanger 220 installed in a second storage space 16 as a first heat exchange portion, and a first fan 310 as a fluid generator. The fluid in the first storage space 15 may circulate through a space in which the first heat exchange portion is installed.

For example, the first heat exchanger 220 may include an evaporator, and the first fan 310 may include a cooling fan. In this case, the first heat exchange portion may constitute a cooling portion for generating cold air.

The refrigeration cycle part may include a compressor 121 and a second heat exchanger 123 as a second heat exchange portion, and a second fan 125 as a fluid generator. The fluid outside the third storage space 17 may circulate through a space in which the second heat exchange portion is installed.

For example, the second heat exchanger 123 may include a condenser, and the second fan 125 may include a condensing fan. In this case, the second heat exchange portion may constitute a heat dissipation portion that dissipates heat.

The heat exchange device 100 may be installed in a device accommodation space 18. The device accommodation space 18 may include a second storage space 16 in which the first heat exchanger 220 is installed, and a third storage space 17 in which the second heat exchanger 123 is installed.

The first storage space 15 and the device accommodation space 18 may be separated by a partition wall 50.

The partition wall 50 may be located between the storage space 15 and the device accommodation space 18.

For example, the partition wall 50 may vertically separate the first storage space 15 and the device accommodation space 18.

For example, the partition wall 50 may constitute a part of a body inner case 12.

The partition wall 50 may include a wall insulating material 56 (see FIG. 26) for insulating the first storage space 15 and the device accommodation space 18.

The device accommodation space 18 may be located below the first storage space 15.

The device accommodation space 18 may have a smaller volume than the first storage space 15.

The heat exchange device 100 may be located at the lower end portion of the storehouse body 10.

An inlet portion 51 through which the fluid in the first storage space 15 is introduced into the second storage space 16 of the heat exchange device 100 is defined in the partition wall 50. The inlet portion 51 may pass through the partition wall 50 to communicate with the second storage space 16 of the heat exchange device 100.

The inlet portion 51 may include a hole defined to be lengthwise in the left-and-right direction.

The storehouse 1 may further include a cover 150 that is provided in front of the heat exchange device 100 and introduces the fluid from the outside of the third storage space 17.

The cover 150 may include a cover body 151 having a size corresponding to the front surface of the heat exchange device 100, a cover inlet portion 152 through which the fluid is introduced into the third storage space 17, and a cover outlet portion 153 through which the fluid passing through the third storage space 17 of the heat exchange device 100 is discharged.

The cover inlet portion 152 and the cover outlet portion 153 may be disposed on both sides of the cover body 151.

The cover inlet portion 152 may be located in front of the second heat exchanger 123. The cover outlet portion 153 may be located in front of the compressor 121.

The fluid, which is introduced into the third storage space 17 of the heat exchange device 100 through the cover inlet portion 152, may be heat-exchanged through the second heat exchanger 123 and the compressor 121 and may be discharged to the outside of the storehouse through the cover outlet portion 153.

The second heat exchange portion of the heat exchange device 100 may be disposed in the front region of the heat exchange device 100. The second heat exchange portion may include a compressor 121, a second fan 125, and a second heat exchanger 123.

The compressor 121, the second fan 125, and the second heat exchanger 123 may be disposed in the left-and-right direction. The compressor 121, the second fan 125, and the second heat exchanger 123 may be disposed in a line.

The second fan 125 may be disposed between the compressor 121 and the second heat exchanger 123.

The second fan 125 may include an axial fan.

The first heat exchange portion of the heat exchange device 100 may be disposed in the rear region of the heat exchange device 100. The first heat exchange portion may include the first heat exchanger 220 and the first fan 310.

The first heat exchange portion further includes a heat exchanger case 200 defining a space (case accommodation portion) 205 accommodating the first heat exchanger 220. The heat exchanger case 200 may be separated from the second heat exchange portion and configured to have an insulating wall.

The case accommodation portion 205 of the heat exchanger case 200 may define at least a part of the second storage space 16.

The heat exchanger case 200 includes a case body 210 provided in the rear of the second heat exchange portion. The case body 210 may have a polyhedral shape (e.g., a hexahedral shape) with an opened upper end portion.

The first heat exchanger 220 may be disposed inside the heat exchanger case 200.

The inner space of the heat exchanger case 200 may define at least a part of the second storage space 16. The heat exchanger case 200 may include a case insulating material 213 that insulates the inner space and the outer space of the heat exchanger case 200.

The fluid, which is heat-exchanged while passing through the first heat exchanger 220, may flow to the duct 30 of the storehouse body 10 and may be supplied to the first storage space 15 through the duct discharge hole 35.

The heat exchanger case 200 may be coupled to the storehouse body 10.

The heat exchanger case 200 may be in close contact with the partition wall 50.

The heat exchanger case 200 further includes a sealing member 240 that seals the space between the heat exchanger case 200 and the partition wall 50.

The sealing member 240 may be provided on the upper surface of the heat exchanger case 200 and may be in contact with the bottom surface of the partition wall 50.

The sealing member 240 may include a gasket, an O-ring, or a square ring.

A sealing groove **210*e*, in which the sealing member 240 is installed, may be defined in a case top portion 210*c* of the heat exchanger case 200. The sealing groove 210*e* may be defined by being recessed in the case top portion 210*c***.

For example, the sealing groove **210*e* may have a quadrangular groove shape corresponding to the shape of the sealing member 240**.

Before the heat exchanger case 200 is coupled to the first storage space 15, the sealing member 240 may protrude from the heat exchanger case 200 by a predetermined height.

After the heat exchanger case 200 is coupled to the first storage space 15, the sealing member 240 is pressed by the partition wall 50 to achieve sealing. In this process, the protruding height of the sealing member 240 may be reduced or eliminated.

The heat exchange device 100 may further include a base 110 on which at least one of the first heat exchange portion and the second heat exchange portion is installed. The base 110 may have a shape corresponding to the lower end portion of the storehouse body 10.

The base 110 may form at least a part of a common plate.

It is shown that the first and second heat exchange portions are installed on the base 110 together. However, unlike this, the first and second heat exchange portions may be installed on separate bases, and the first heat exchange portion or the second heat exchange portion may be installed on the ground without a base.

For example, when the base 110 is provided with the common plate of the first and second heat exchangers, the upper surface of the base 110 may provide the installation surface of the first and second heat exchangers, the second heat exchanger 123 may be disposed on the front portion of the installation surface, and the first heat exchanger 220 may be disposed in the rear portion of the installation surface.

The compressor 121, the second fan 125, and the second heat exchanger 123 are provided on the front portion of the installation surface. The second fan 125 may be provided between the compressor 121 and the second heat exchanger 123.

The base 110 may include a compressor support portion 121*a* that supports the compressor 121. A plurality of compressor support portions 121*a* may be provided and may be coupled to legs of the compressor 121.

The first heat exchanger 220 may be installed on the base 110. The rear portion of the base 110 may define the installation space for the first heat exchanger 220.

The heat exchange device 100 may further include a tray 130 for collecting the fluid discharged from the heat exchanger case 200, for example, water or water vapor. When the first heat exchanger 220 is configured as an evaporator, the fluid may include condensed water.

The tray 130 may include a fluid collecting surface for collecting the fluid and an edge portion protruding upward from the edge of the fluid collecting surface to prevent overflow of the fluid. The edge portion may include a wall (storage wall) that blocks the flow of collected water or water vapor so as to store the collected water or water vapor.

The heat exchanger case 200 may be seated on the upper side of the tray 130.

The heat exchanger case 200 may include a hot line pipe 260 through which a high-temperature refrigerant flows. The hot line pipe 260 may be buried in the wall surface of the heat exchanger case 200. A high-temperature refrigerant, which is condensed in the second heat exchanger 123, may flow through the hot line pipe 260, and may extend to the front of the storehouse body 10 to perform a function of preventing dew condensation.

First through holes 216*a* and 216*b*, through which the hot line pipe 260 buried in the wall surface is drawn out, may be defined in the heat exchanger case 200. The hot line pipe 260, which is drawn out of the heat exchanger case 200 through the first through holes 216*a* and 216*b*, may extend to the front of the storehouse body 10. The first through holes 216*a* and 216*b* may be referred to as "hot line through holes".

The storehouse 1 may further include a roller 19*a* provided in the lower end portion of the storehouse body 10 for easy movement of the storehouse 1. The rollers 19*a* may be provided on both sides of the rear portion of the storehouse body 10.

An adjustment device 19*b* for adjusting the height (flatness) of the storehouse body 10 may be provided at the front portion of the storehouse body 10.

Figure 5:
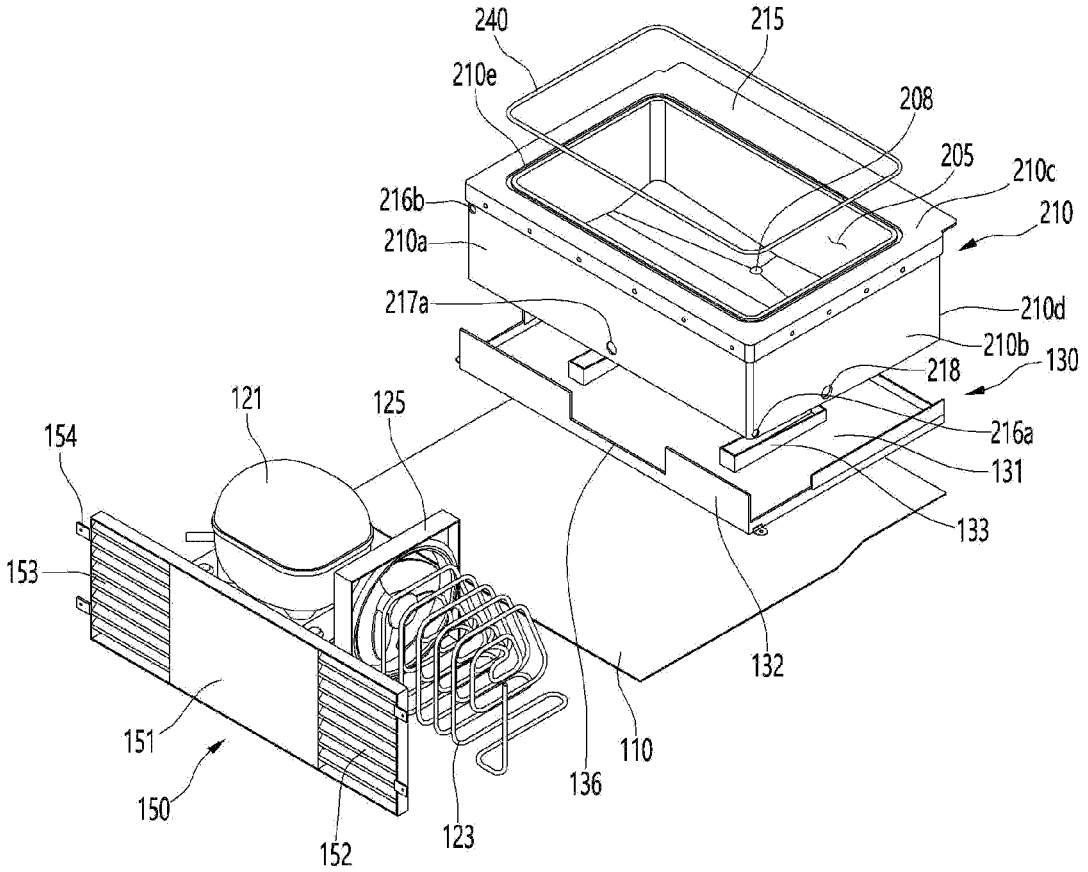
FIG. 5 is an exploded perspective view of the heat exchange device according to an embodiment of the present disclosure.
Figure 6:
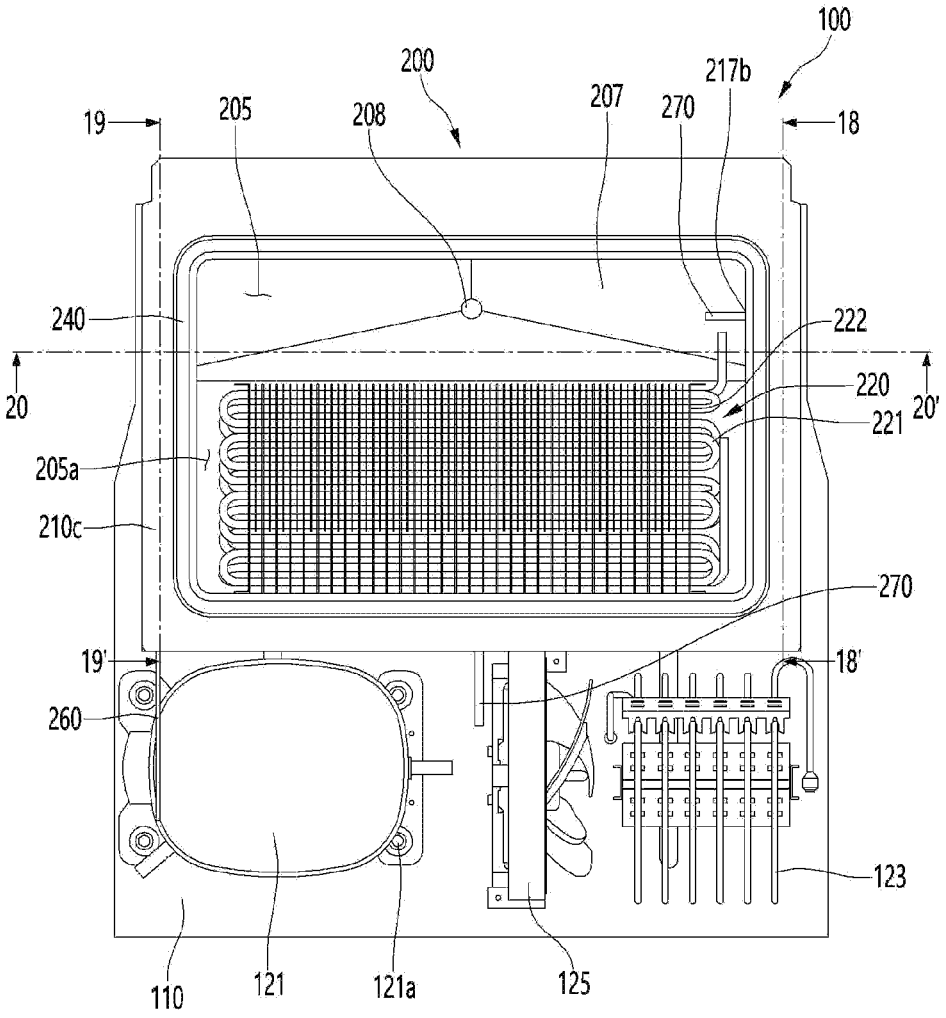
FIG. 6 is a plan view of a partial configuration of the heat exchange device according to an embodiment of the present disclosure.

FIG. 5 is an exploded perspective view of the heat exchange device according to an embodiment of the present disclosure, and FIG. 6 is a plan view of a partial configuration of the heat exchange device according to an embodiment of the present disclosure.

The configuration of the heat exchange device 100 according to an embodiment of the present disclosure will be described in more detail with reference to FIGS. 5 and 6.

The tray 130 according to an embodiment of the present disclosure may include a tray body 131 defining a fluid collecting surface. For example, the tray body 131 may have a quadrangular plate shape.

The tray 130 may further include a storage wall 132 provided on the edge of the tray body 131 and protruding upward. The storage wall 132 may prevent the fluid collected in the tray 130 from overflowing.

The tray 130 may further include a support wall 133 provided on the tray body 131 to support the heat exchanger case 200. The support wall 133 may protrude upward from the tray body 131.

A plurality of support walls 133 may be provided. The plurality of support walls 133 may be spaced apart from each other in the left-and-right direction of the tray 130.

The support wall 133 may be provided to be inclined downward to the rear. Therefore, the heat exchanger case 200 supported by the support wall 133 may be disposed to be inclined downward to the rear.

A drain hole 208, through which the fluid is discharged, is defined in the bottom surface of the heat exchanger case 200. The drain hole 208 may be defined in the rear portion of the bottom surface of the heat exchanger case 200. Since the heat exchanger case 200 is disposed to be inclined downward to the rear, the condensed water present in the heat exchanger case 200 may be easily discharged through the drain hole 208.

The fluid discharged through the drain hole 208 may be collected in the tray 130.

At least some storage walls 132 of the tray 130 may support at least one of the front and rear surfaces and the left and right side surfaces of the heat exchanger case 200.

A tray recessed portion 136 may be defined in at least one of the plurality of storage walls 132 of the tray 130. At least a part of a refrigerant pipe constituting the second heat exchange portion may be configured to pass through the tray recessed portion 136.

The tray recessed portion 136 may be formed at a position adjacent to a discharge pipe 121*c* of the compressor 121.

The heat exchanger case 200 may have a hexahedral shape with an opened upper end portion. The heat exchanger case 200 may include a case front portion 210*a*, a case side portion 210*b* extending rearward from both sides of the case front portion 210*a*, a case top portion 210*c* forming the upper end portion of the heat exchanger case 200, and a case rear portion 210*d* facing the case front portion 210*a*.

The heat exchanger case 200 may include a case extension portion 215 that further extends rearward from the case top portion 210*c*.

When the heat exchanger case 200 is coupled to the storehouse body 10, that is, the first storage space 15, the case extension portion 215 may be understood as a portion located adjacent to or in contact with the lower end portion of the rear wall of the storehouse body 10.

The first through holes 216*a* and 216*b*, through which the hot line pipe 260 is drawn out, may be defined in the heat exchanger case 200.

The first through holes 216*a* and 216*b* may include one through hole 216*a* through which an outlet pipe extending from the outlet side of the second heat exchanger 123 in the hot line pipe 260 passes; and other through hole 216*b* through which an outlet pipe extending toward the front side of the storehouse body 10 in the hot line pipe 260 passes.

The one through hole 216*a* may be defined at a position adjacent to the pipe on the outlet side of the second heat exchanger 123. For example, the one through hole 216*a* may be defined in the case side portion 210*b*.

Figure 23:
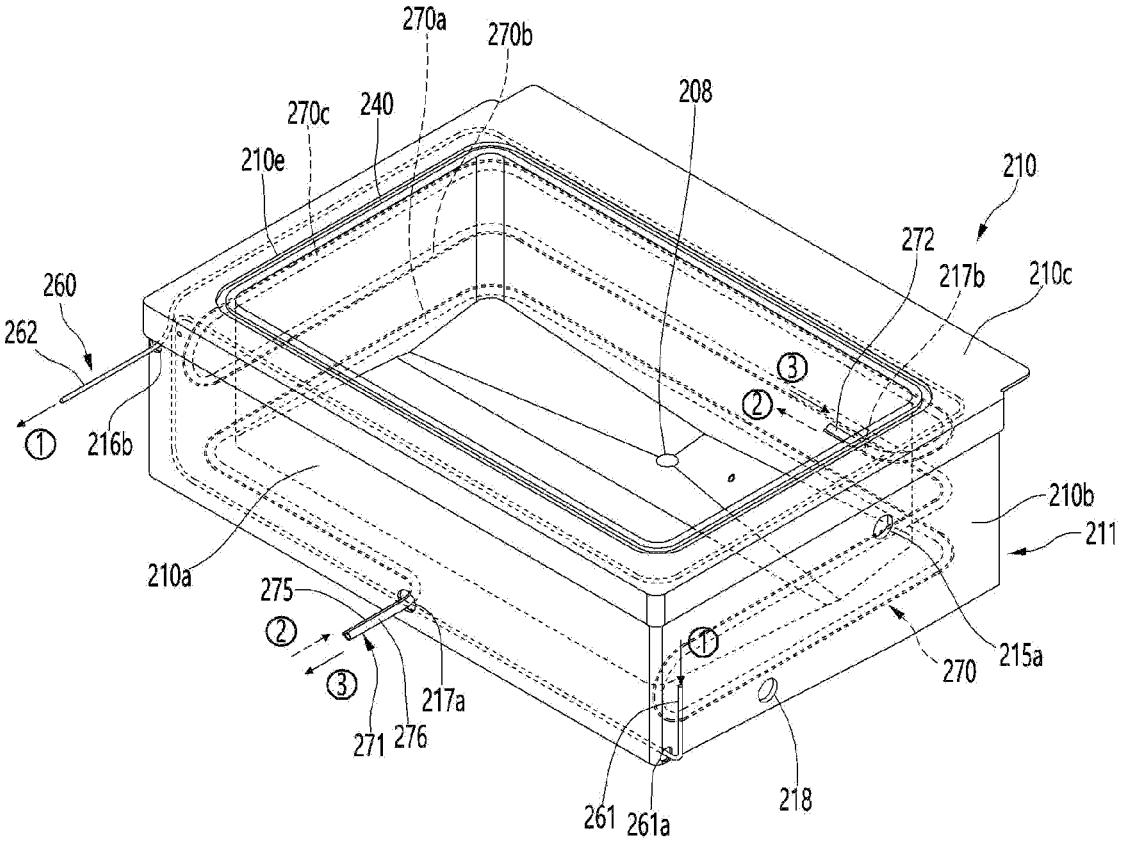
FIG. 23 is a perspective view showing a refrigerant flow in an SLHX and a hot line pipe in a heat exchanger case according to an embodiment of the present disclosure.

The other through hole 216*b* may be defined at a position adjacent to a door side pipe (see 280 of FIG. 23). For example, the other through hole 216*b* may be defined in the case front portion 210*a*.

In the heat exchanger case 200, second through holes 217*a* and 217*b* through which a suction line heat exchanger (SLHX) 270 is drawn out may be defined. The SLHX 270 may include a first refrigerant pipe 276 and a second refrigerant pipe 275. For example, a low-pressure gas refrigerant may flow through the first refrigerant pipe 276, and a condensed refrigerant may flow through the second refrigerant pipe 275.

The first refrigerant pipe 276 and the second refrigerant pipe 275 may be disposed adjacent to each other to enable heat exchange.

For example, the first refrigerant pipe 276 and the second refrigerant pipe 275 may be disposed in contact with each other to enable heat exchange. The first refrigerant pipe 276 and the second refrigerant pipe 275 may be contacted by soldering, but the contact method is not limited thereto.

The first through holes 217*a* and 217*b* may include one through hole 217*a* through which an outlet pipe extending from the front of the heat exchanger case 200 in the SLHX 270 passes; and other through hole 217*b* through which an outlet pipe drawn out from the inner surface of the heat exchanger case 200 in the SLHX 270 passes.

The one through hole 217*a* may be defined at a position adjacent to the compressor 121. For example, the one through hole 217*a* may be defined in the case front portion 210*a*.

The other through hole 217*b* may be defined at a position adjacent to the first heat exchanger 220. The other through hole 217*b* may be defined on the inner surface of the heat exchanger case 200.

The heat exchanger case 200 may include a third through hole 218. The third through hole 218 may be understood as a hole through which a heat insulating foam is injected so as to form a heat insulating material in the heat exchanger case 200. The third through hole 218 may be defined in, for example, the case side portion 210*b*.

The fluid, which is introduced into the heat exchanger case 200, may pass through the first heat exchanger 220 and may be sucked through the first fan 310. The fluid discharged from the first fan 310 may flow through the duct 30.

A passage is defined in the heat exchanger case 200. The passage may be defined in the case accommodation portion 205 in which the first heat exchanger 220 and the fan assembly 300 are installed.

As an example, when the first heat exchanger 220 is configured as an evaporator, the first heat exchanger may include a refrigerant pipe 221 through which a refrigerant flows, and a fin 222 coupled to the refrigerant pipe 221. The refrigerant pipe 221 may be formed in multiple stages, and both sides of the refrigerant pipe 221 may have a bent shape.

A plurality of fins 222 may be provided. The plurality of fins 222 may be spaced apart from each other in the left-and-right direction. The fin 222 may extend in the front-and-rear direction.

The heat exchange surface of the fin 222 may be disposed to face the left-and-right inner surfaces of the heat exchanger case 200.

Due to the refrigerant pipe 221 and the fin 222, the first heat exchanger 220 may be configured to have a hexahedral shape as a whole. The case accommodation portion 205 may be defined by recessing downward from the upper end portion of the heat exchanger case 200 to correspond to the shape of the first heat exchanger 220.

A drain hole 208, through which the fluid generated in the first heat exchanger 220 or the first fan 310 is discharged, may be defined in the heat exchanger case 200. The drain hole 208 may be defined in the inner lower surface of the heat exchanger case 200.

The drain hole 208 may be defined in the lower surface 207 of the case accommodation portion 205.

The lower surface 207 of the case accommodation portion 205 may be inclined downward toward the drain hole 208. Therefore, the fluid generated in the first heat exchanger 220 or the first fan 310 may fall and easily flow toward the drain hole 208.

The drain hole 208 may be defined in the central portion of the heat exchanger case 200 with respect to the left-and-right direction. That is, the distance from the drain hole 208 to the left end of the heat exchanger case 200 may be equal to the distance from the drain hole 208 to the right end of the heat exchanger case 200.

The left portion and the right portion of the heat exchanger case 200 may be symmetrical with respect to the drain hole 208.

A center line (ℓ1) in the front-and-rear direction passing through the center of the first heat exchanger 220 may pass through the center of the heat exchanger case 200.

The center line in the front-and-rear direction passing through the center of the first heat exchanger 220 may pass through the center of the drain hole 208.

The cover 150 may constitute at least a part of the third wall of the third storage space 17.

The cover 150 may define the lower appearance of the storehouse 1 when the door 20 is opened.

Coupling brackets 154 coupled to the side walls of the device accommodation space 18 may be provided on both sides of the cover 150. The coupling brackets 154 may protrude outward from both ends of the cover body 151.

A plurality of coupling brackets 154 may be provided at the side end portion of the cover body 151 and spaced apart from each other in the vertical direction.

For example, the coupling bracket 154 may define a coupling hole, and a predetermined coupling member may be inserted into the coupling hole and coupled to the side wall of the device accommodation space 18.

The height of the upper end portion of the cover 150 may correspond to the height of the bottom of the partition wall 50. The opened front end portion of the device accommodation space 18 may be shielded by the cover 150.

Hereinafter, the configuration of the heat exchanger case 200 and the connection structure of the SLHX 270 and the hot line pipe 260 will be described in more detail.

Figure 7:
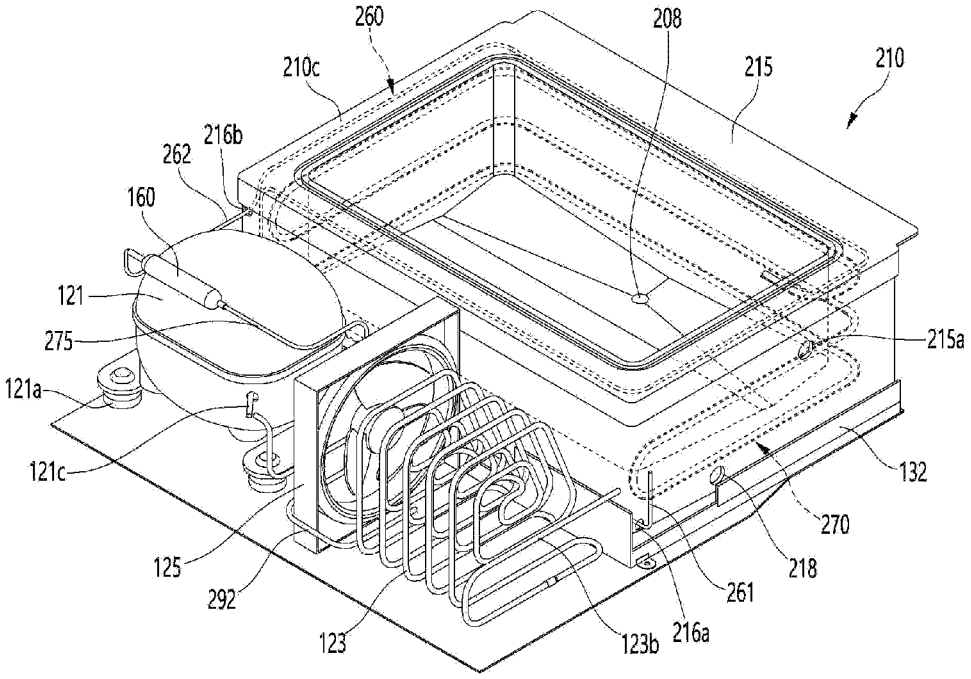
FIG. 7 is a view showing a state in which a plurality of components of the heat exchange device are connected to a refrigerant pipe, according to an embodiment of the present disclosure.
Figure 8:
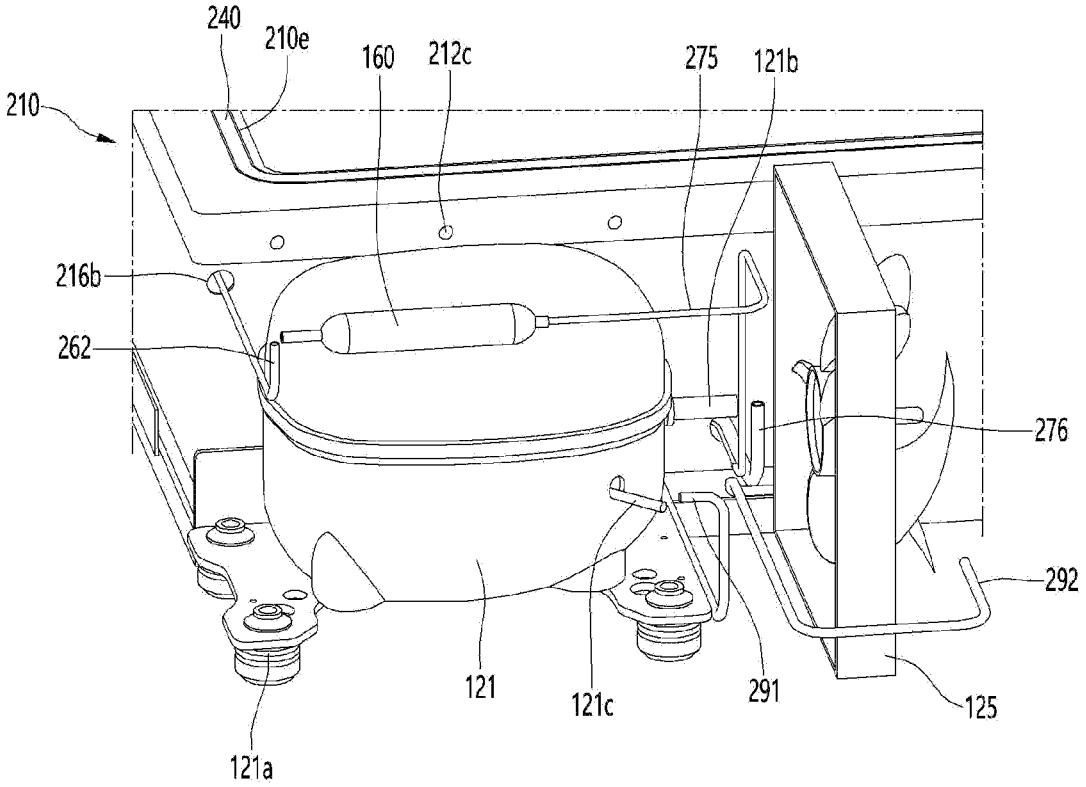
FIG. 8 is a view showing a state in which a refrigerant pipe around a compressor and a second fan is connected, according to an embodiment of the present disclosure.
Figure 9:
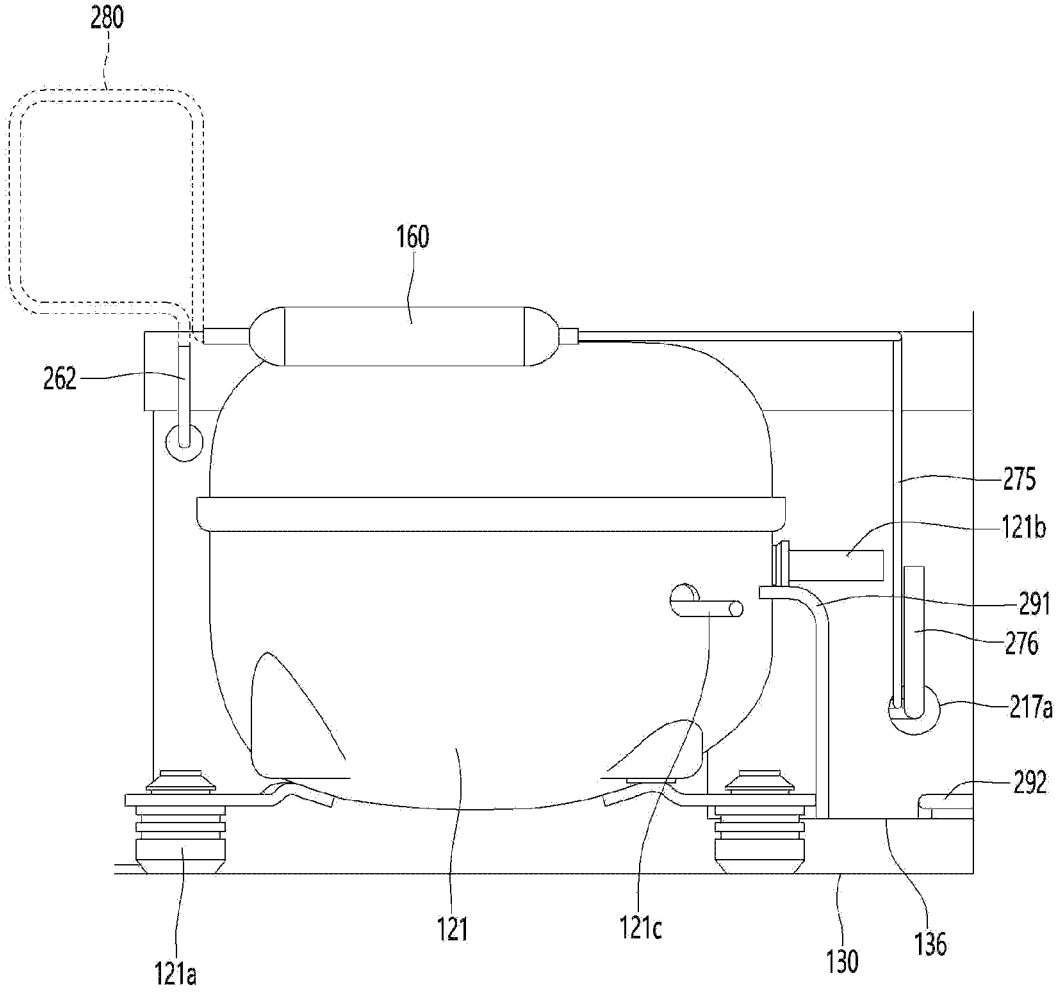
FIG. 9 is a view showing a state in which a refrigerant pipe around a compressor is connected, according to an embodiment of the present disclosure.
Figure 10:
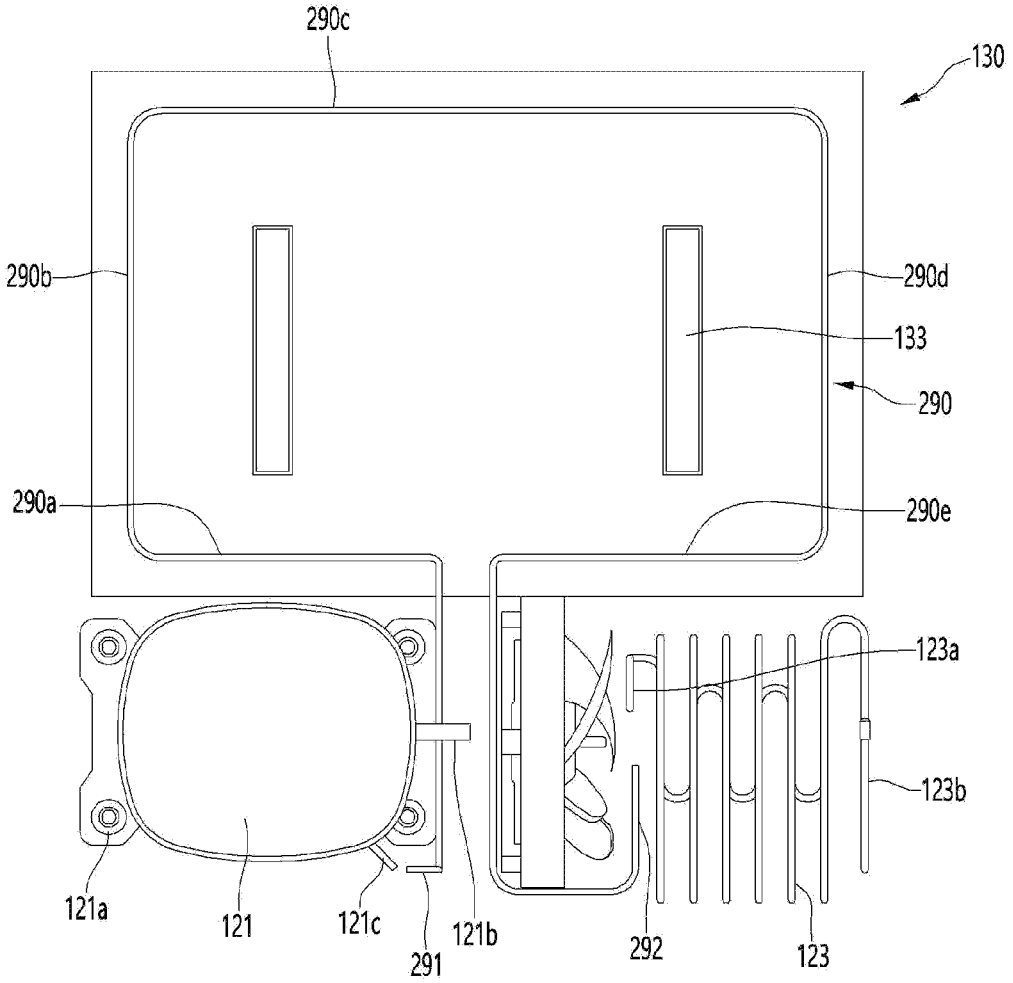
FIG. 10 is a plan view showing a state in which a compressor and a tray pipe are connected, according to an embodiment of the present disclosure.
Figure 11:
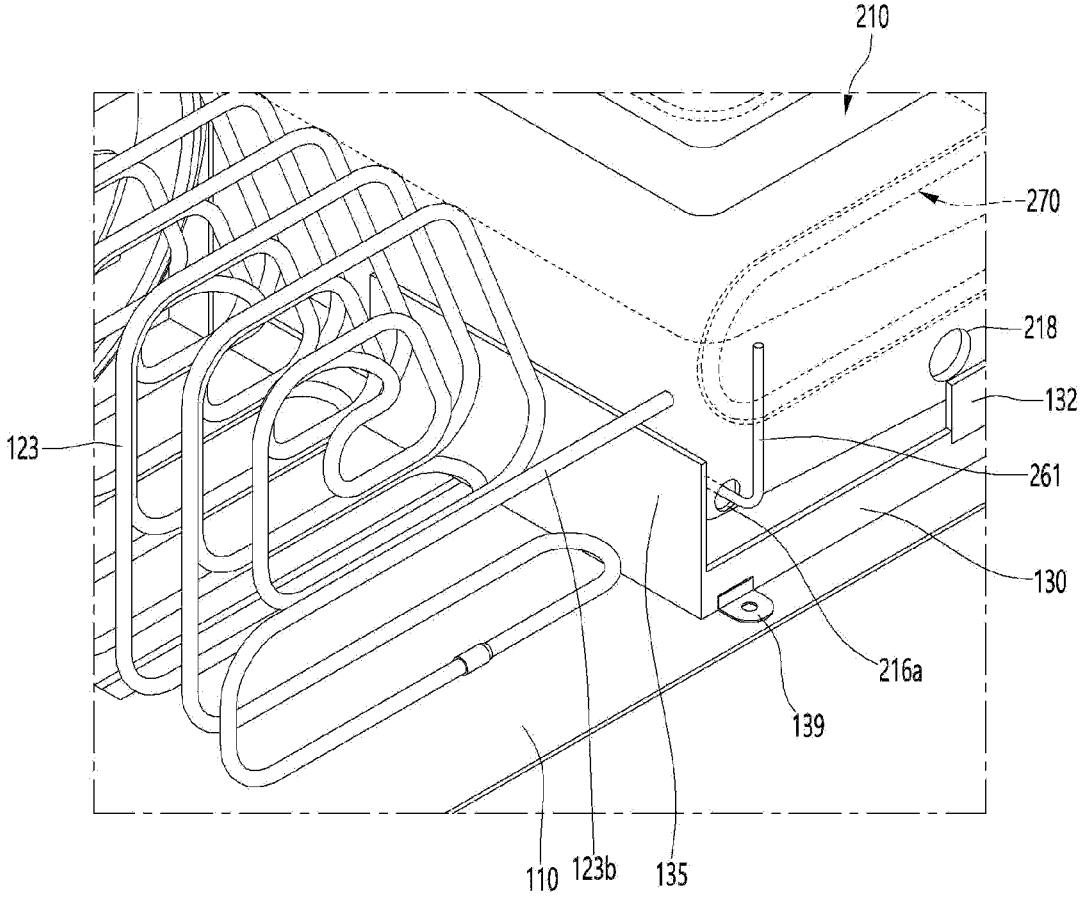
FIG. 11 is a view showing a state in which an outlet pipe of a condenser and a hot line pipe are connected, according to an embodiment of the present disclosure.
Figure 12:
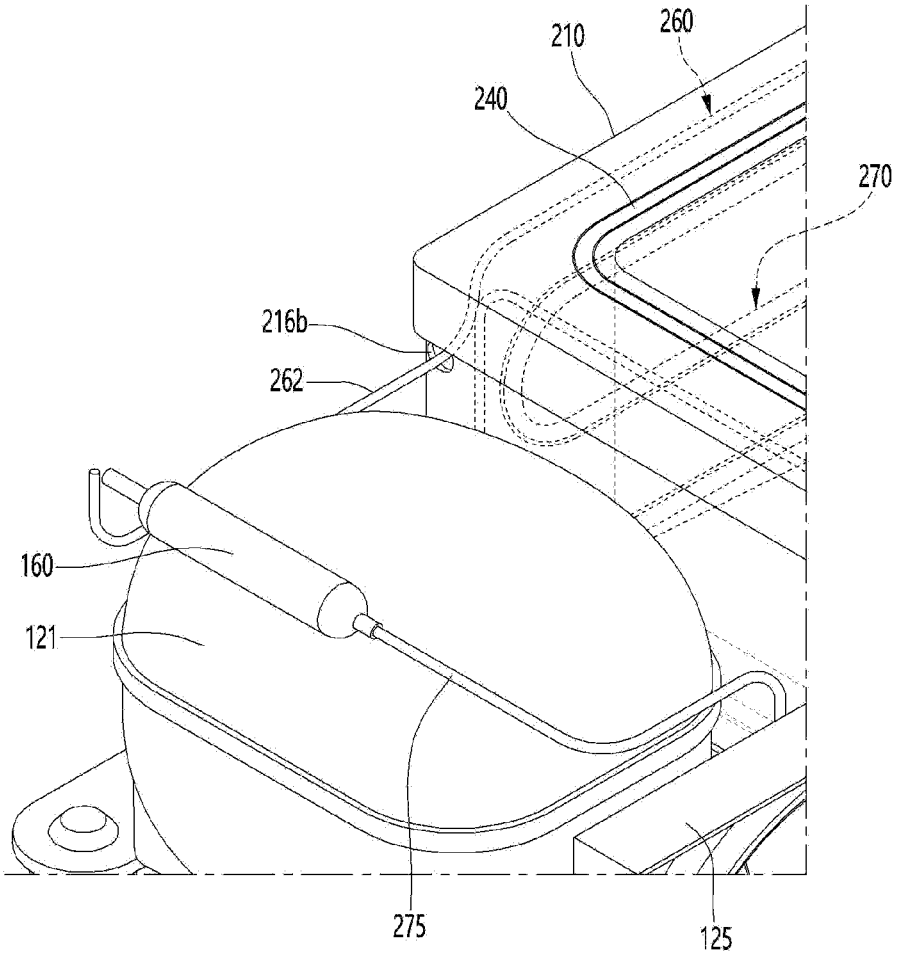
FIG. 12 is a view showing a state in which a hot line pipe and a dryer are connected, according to an embodiment of the present disclosure.
Figure 13:
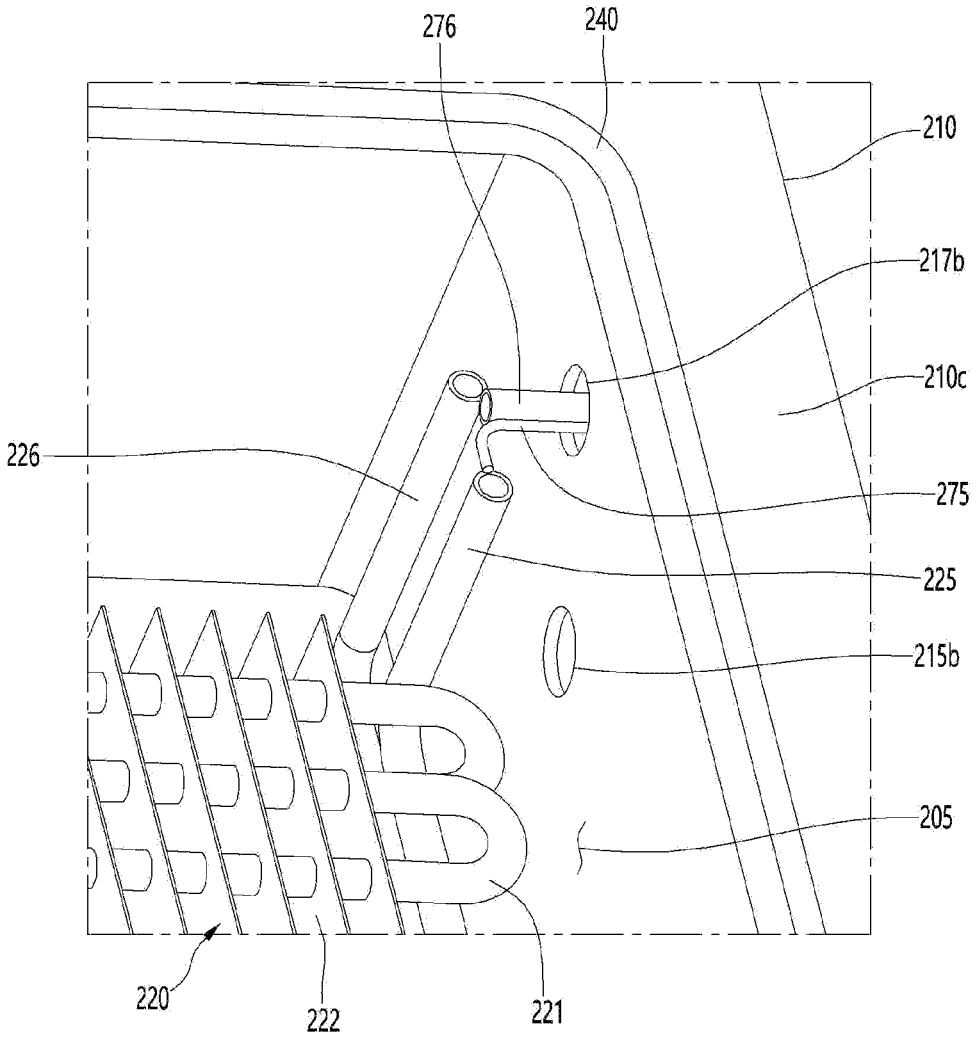
FIG. 13 is a view showing a state in which an evaporator and a suction line heat exchanger (SLHX) are connected in a heat exchanger case, according to an embodiment of the present disclosure.
Figure 14:
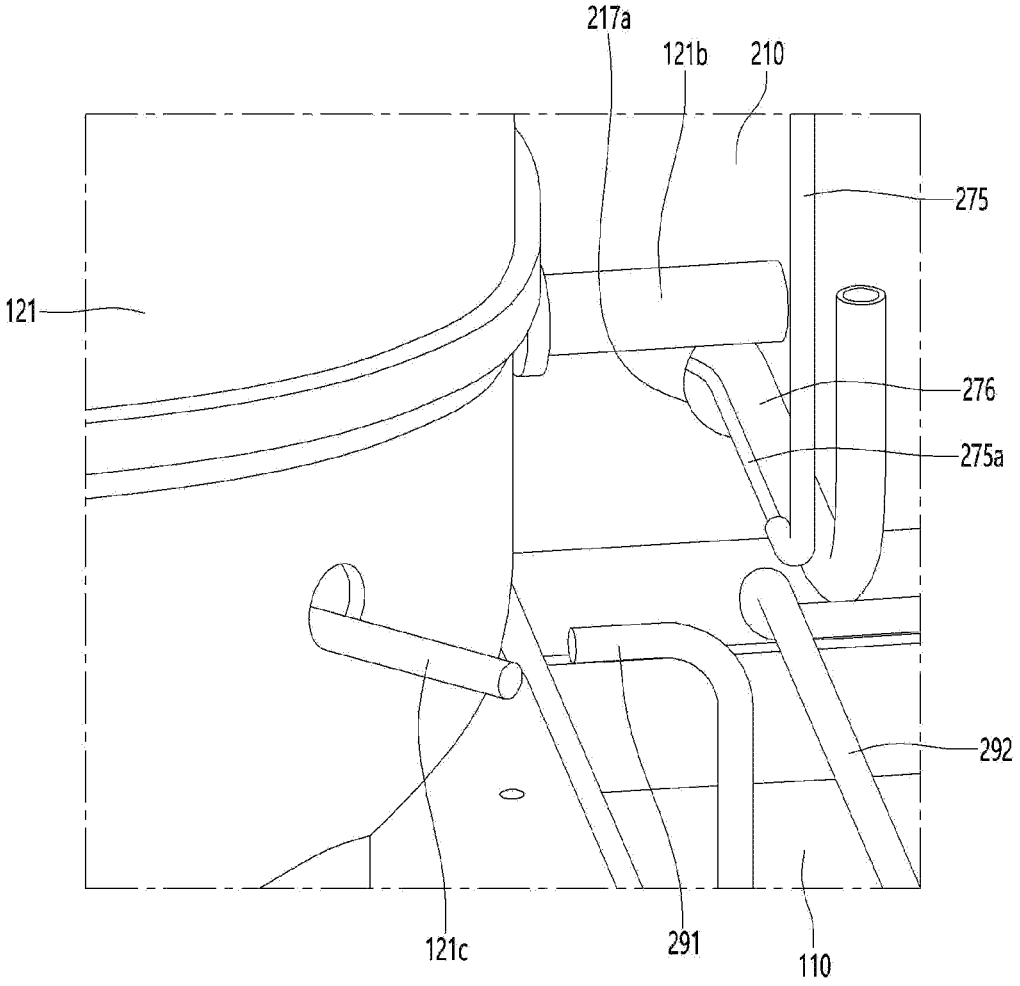
FIG. 14 is a view showing a state in which an SLHX and a suction pipe of a compressor are connected, according to an embodiment of the present disclosure.
Figure 15:
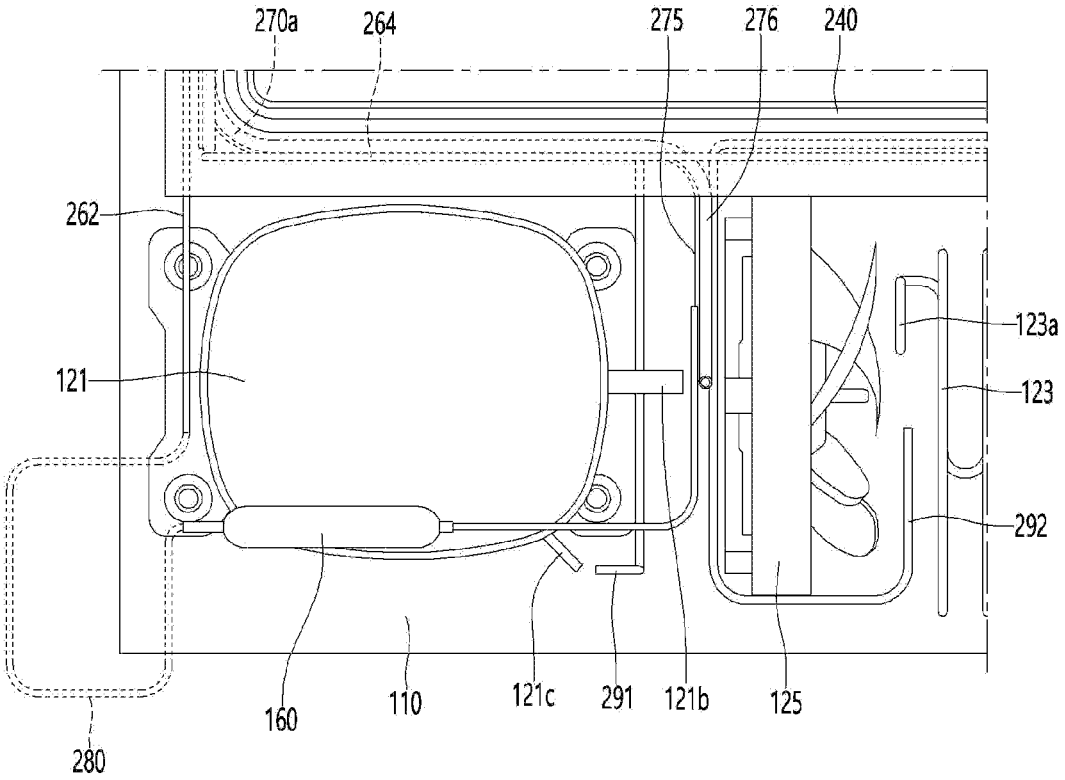
FIG. 15 is a plan view showing a state in which a refrigerant pipe around a compressor and a second fan is connected, according to an embodiment of the present disclosure.
Figure 16:
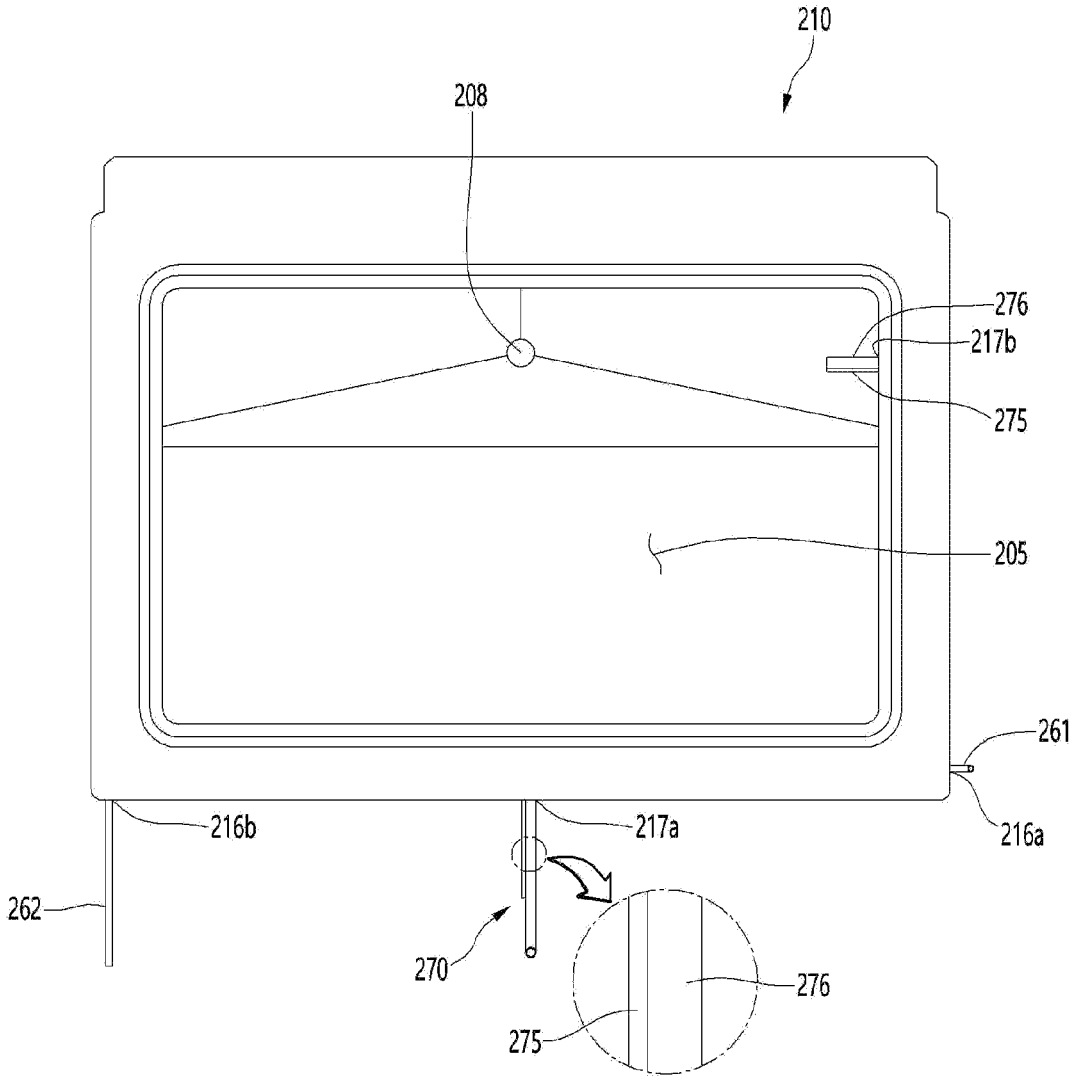
FIG. 16 is a plan view showing a state in which an SLHX heat exchanger and a hot line pipe are buried in a heat exchanger case, according to an embodiment of the present disclosure.

FIG. 7 is a view showing a state in which a plurality of components of the heat exchange device are connected to a refrigerant pipe, according to an embodiment of the present disclosure, FIG. 8 is a view showing a state in which a refrigerant pipe around a compressor and a second fan is connected, according to an embodiment of the present disclosure, FIG. 9 is a view showing a state in which a refrigerant pipe around a compressor is connected, according to an embodiment of the present disclosure, and FIG. 10 is a plan view showing a state in which a compressor and a tray pipe are connected, according to an embodiment of the present disclosure. FIG. 11 is a view showing a state in which an outlet pipe of a condenser and a hot line pipe are connected, according to an embodiment of the present disclosure, FIG. 12 is a view showing a state in which a hot line pipe and a dryer are connected, according to an embodiment of the present disclosure, FIG. 13 is a view showing a state in which an evaporator and a suction line heat exchanger (SLHX) are connected in a heat exchanger case, according to an embodiment of the present disclosure, FIG. 14 is a view showing a state in which an SLHX and a suction pipe of a compressor are connected, according to an embodiment of the present disclosure, FIG. 15 is a plan view showing a state in which a refrigerant pipe around a compressor and a second fan is connected, according to an embodiment of the present disclosure, and FIG. 16 is a plan view showing a state in which an SLHX heat exchanger and a hot line pipe are buried in a heat exchanger case, according to an embodiment of the present disclosure.

Referring to FIGS. 7 to 16, the compressor 121 according to the embodiment of the present disclosure may include a compressor suction pipe 121*b* through which a refrigerant is sucked.

The compressor suction pipe 121*b* may be connected to a first refrigerant pipe 276 through which a low-pressure gas refrigerant evaporated in the first heat exchanger 220 flows. The compressor suction pipe 121*b* may introduce the refrigerant from the first refrigerant pipe 276.

The compressor 121 may include a compressor discharge pipe 121*c* through which the high-pressure refrigerant compressed in the compressor 121 is discharged.

A tray pipe 290 may be connected to the compressor discharge pipe 121*c*. The tray pipe 290 may be understood as a pipe that is disposed on the tray 130 to help evaporating condensed water stored in the tray 130. The high-temperature refrigerant discharged from the compressor discharge pipe 121*c* may flow to the tray pipe 290.

The compressor discharge pipe 121*c* may be connected to a pipe inlet portion 291 defining one end portion of the tray pipe 290.

The compressor suction pipe 121*b* and the compressor discharge pipe 121*c* may extend in different outward directions from a shell forming the outer appearance of the compressor 121.

The tray pipe 290 may be introduced into the fluid collecting space of the tray 130 through the tray recessed portion 136.

The tray pipe 290 may be disposed along the edge of the tray 130.

The tray pipe 290 may include a bent pipe.

For example, the tray pipe 290 may include a first part 290*a* connected to the pipe inlet portion 291 and extending along the first wall of the tray 130, and a second part 290*b* connected to the first part 290*a* and extending along the second wall of the tray 130. The first and second parts 290*a* and 290*b* may be bent.

The tray pipe 290 may include a third part 290*c* connected to the second part 290*b* and extending along the third wall of the tray 130; and a fourth part 290*d* connected to the third part 290*c* and extending along the fourth wall of the tray 130. The third and fourth parts 290*c* and 290*d* may be bent.

The tray pipe 290 may include a fifth part 290*e* connected to the fourth part 290*d* and extending along the first wall of the tray 130. The fifth part 290*e* may be bent from the fourth part 290*d*.

The fifth part 290*e* and the first part 290*a* may extend along the first wall of the tray 130.

For example, the first to fourth walls of the tray 130 may include a front wall, one side wall, a rear wall, and the other side wall, respectively.

The tray pipe 290 may include a pipe outlet portion 292 connected to the fifth part 290*e* and defining an outlet side end portion of the refrigerant. The pipe outlet portion 292 may extend to the outside of the tray 130 through the tray recessed portion 136.

The pipe outlet portion 292 may be connected to a second heat exchanger inlet pipe 123*a*. The second heat exchanger inlet pipe 123*a* may be connected to the inlet side of the second heat exchanger 123 so that the refrigerant is introduced into the second heat exchanger 123. The second heat exchanger inlet pipe 123*a* may constitute at least a part of the second heat exchanger 123.

A second heat exchanger outlet pipe 123*b* may be connected to the outlet side of the second heat exchanger 123. The second heat exchanger outlet pipe 123*b* may guide the discharge of the refrigerant condensed in the second heat exchanger 123, and may constitute at least a part of the second heat exchanger 123.

The second heat exchanger outlet pipe 123*b* may be connected to the hot line pipe 260. The refrigerant of the second heat exchanger outlet pipe 123*b* may guide the refrigerant to the hot line pipe 260. The hot line pipe 260 may include a hot line inlet portion 261 connected to the second heat exchanger outlet pipe 123*b*. The hot line pipe 260 may be buried in the heat exchanger case 200.

The hot line pipe 260 drawn out from the heat exchanger case 200 may be connected to a door side pipe 280, so that the refrigerant on the outlet side of the hot line pipe 260 may be introduced into the door side pipe 280. The hot line pipe 260 may include a hot line outlet portion 262 connected to the door side pipe 280.

The door side pipe 280 may be provided on the first wall of the first storage space 15, and may be provided near a portion where the first wall is in contact with the door 20. The door side pipe 280 may reduce dew generated at a portion where the first wall is in contact with the door 20.

The door side pipe 280 may be connected to a second refrigerant pipe 275, and the refrigerant of the door side pipe 280 may be introduced into the second refrigerant pipe 275.

For example, a dryer 160 configured to remove moisture or foreign material in the refrigerant may be provided between the door side pipe 280 and the second refrigerant pipe 275. The door side pipe 280 may be connected to the inlet side of the dryer 160, and the second refrigerant pipe 275 may be connected to the outlet side of the dryer 160. However, the dryer 160 may be omitted.

The door side pipe 280 may include a first side portion 281 connected to the hot line pipe 260 and a second side portion 282 connected to the dryer 160.

The second refrigerant pipe 275 may constitute a part of the SLHX 270.

The second refrigerant pipe 275 may be buried in the wall surface of the heat exchanger case 200 through a second inlet through hole 217*a*.

The outlet side of the second refrigerant pipe 275 may be connected to a first heat exchanger inlet pipe 225.

For example, the second refrigerant pipe 275 may extend into the inner space of the heat exchanger case 200 through the second outlet through hole 217*b*.

The first heat exchanger inlet pipe 225 may be provided on the inlet side of the first heat exchanger 220 to introduce the refrigerant of the second refrigerant pipe 275. The refrigerant introduced into the first heat exchanger 220 through the first heat exchanger inlet pipe 225 may evaporate in the process of passing through the first heat exchanger 220.

The second refrigerant pipe 275 may include a capillary tube (see 275*a* of FIG. 21) for decompression of the refrigerant. For example, the capillary tube 275*a* may constitute at least a part of the second refrigerant pipe 275.

A first heat exchanger outlet pipe 226 to which the first refrigerant pipe 276 is connected may be provided on the outlet side of the first heat exchanger 220.

The first heat exchanger inlet pipe 225 and the first heat exchanger outlet pipe 226 may be formed adjacent to the second outlet through hole 217*b*. For example, the first heat exchanger inlet pipe 225 and the first heat exchanger outlet pipe 226 may be provided adjacent to the case side portion 210*b* of the heat exchanger case 200.

The first refrigerant pipe 276 may constitute a part of the SLHX 270.

The first refrigerant pipe 276 may be buried in the wall surface of the heat exchanger case 200 through the second outlet through hole 217*a*.

The outlet side of the first refrigerant pipe 276 may be connected to the compressor suction pipe 121*b*.

For example, the first refrigerant pipe 276 may extend to the outer space of the heat exchanger case 200 through the second inlet through hole 217*a*, and may be connected to the compressor suction pipe 121*b*.

The SLHX 270 may be understood as a component for improving the performance of the refrigeration cycle by performing heat exchange between the high-pressure condensed refrigerant and the low-pressure gas refrigerant.

For example, the SLHX 270 may be configured so that the first refrigerant pipe 276 through which the low-pressure refrigerant passing through the first heat exchanger 220 flows and the second refrigerant pipe 275 through which the refrigerant condensed in the condenser 213 flows are in contact with each other to exchange heat by conduction.

The second refrigerant pipe 275 may include a capillary tube 275*a* for decompression of the refrigerant. The capillary tube 275*a* may constitute at least a part of the second refrigerant pipe.

The capillary tube 275*a* may be in contact with the first refrigerant pipe 276 for conduction heat exchange.

For example, the first refrigerant pipe 276 and the second refrigerant pipe 275 may be coupled to each other by soldering. However, the bonding method is not limited thereto.

The SLHX 270 may be formed to be long.

The SLHX 270 may be disposed along a corner where a plurality of walls meet each other.

For example, the SLHX 270 may be bent multiple times and formed in multiple stages so as to be installed on the wall of the heat exchanger case 200.

The SLHX 270 includes a first heat exchange portion 270*a* disposed below the heat exchanger case 200 in the vertical direction, a second heat exchange portion 270*b* connected to the first heat exchange portion 270*a* and disposed in the central portion of the heat exchanger case 200, and a third heat exchange portion 270*c* connected to the second heat exchange portion 270*b* and disposed above the heat exchanger case 200.

The heat exchanger 270 may be buried in the case insulating material 213. Therefore, the amount of heat emitted from the heat exchanger 270 may be prevented from being transferred toward the case accommodation portion 205.

A hot line pipe 260 may be buried in the wall surface of the heat exchanger case 200.

A high-pressure refrigerant condensed in the second heat exchanger 123 may flow through the hot line pipe 260. The hot line pipe 260 may be drawn out of the heat exchanger case 200 through the first through holes 216*a* and 216*b*.

The inlet side of the hot line pipe 260 may pass through the first inlet through hole 216*a* among the first through holes 216*a* and 216*b*, and may extend to the outside of the heat exchanger case 200.

The inlet side of the hot line pipe 260 may be connected to the outlet side of the second heat exchanger 123.

The outlet side of the hot line pipe 260 may pass through the first outlet through hole 216*b* among the first through holes 216*a* and 216*b*, and may extend to the outside of the heat exchanger case 200.

For example, the outlet side of the hot line pipe 260 may extend to the front wall adjacent to the door 20 among the first walls forming the first storage space 15.

The hot line pipe 260 may be buried in the case insulating material 213 provided in the heat exchanger case 200. Therefore, the amount of heat emitted from the hot line pipe 260 may be prevented from being transferred toward the case accommodation portion 205.

Figure 17:
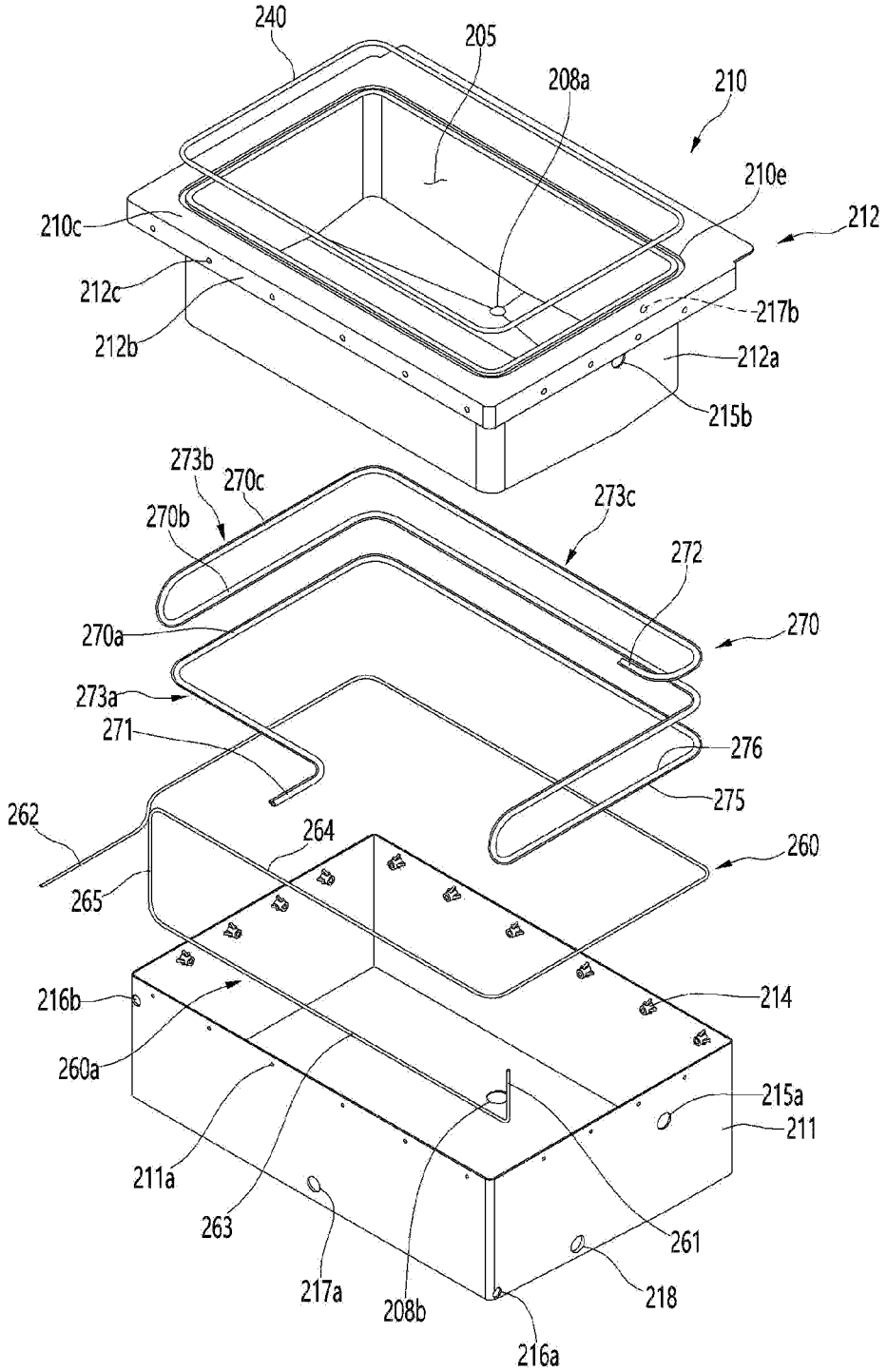
FIG. 17 is an exploded perspective view of the heat exchanger case.
Figure 18:
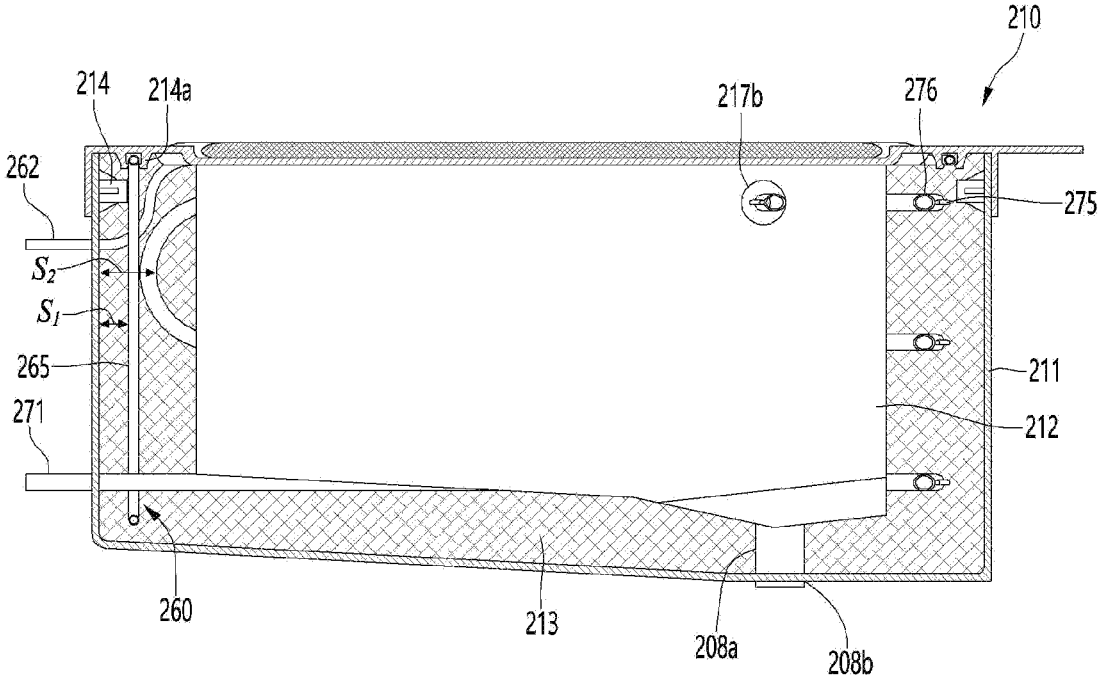
FIG. 18 is a cross-sectional view taken along line 18-18' of FIG. 6.
Figure 19:
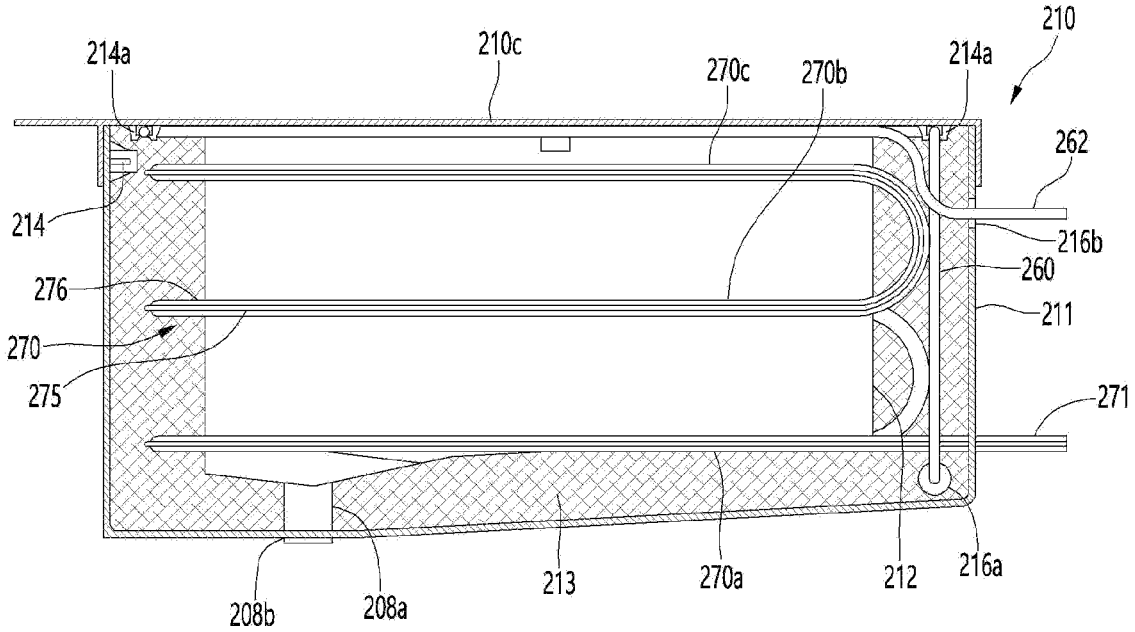
FIG. 19 is a cross-sectional view taken along line 19-19' of FIG. 6.
Figure 20:
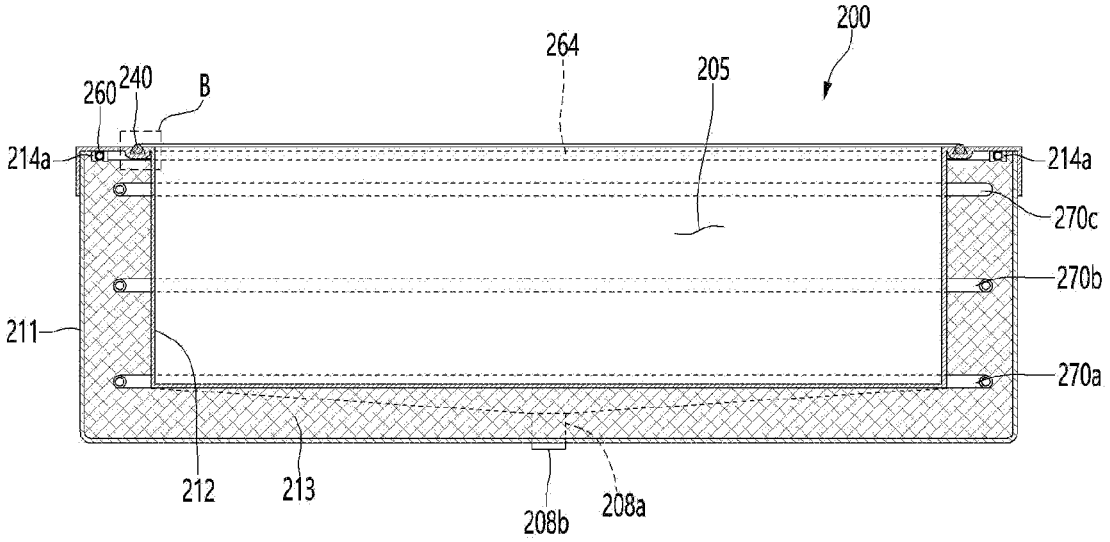
FIG. 20 is a cross-sectional view taken along line 20-20' of FIG. 6 and is a view showing a configuration of a heat exchanger case provided with a sealing member, according to a first embodiment.
Figure 21:
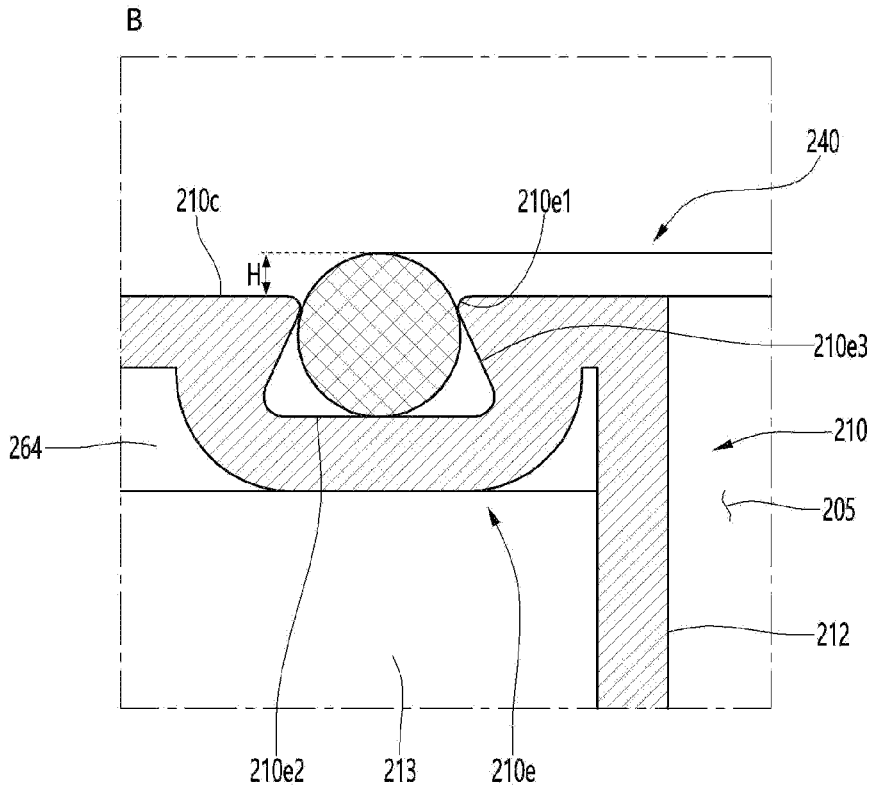
FIG. 21 is an enlarged view of a portion "B" of FIG. 20 and is a view showing the configuration of the sealing member according to the first embodiment.
Figure 22:
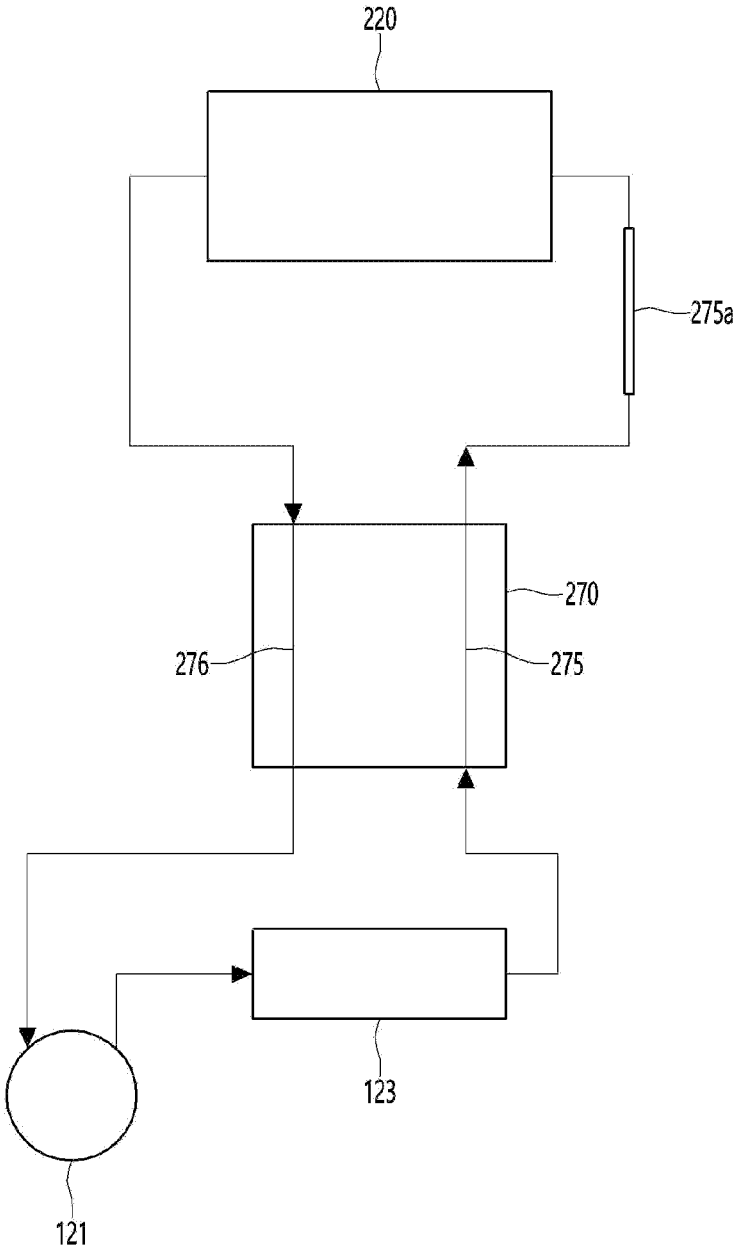
FIG. 22 is a cycle diagram showing a configuration of a heat exchange device according to an embodiment of the present disclosure.
Figure 24:
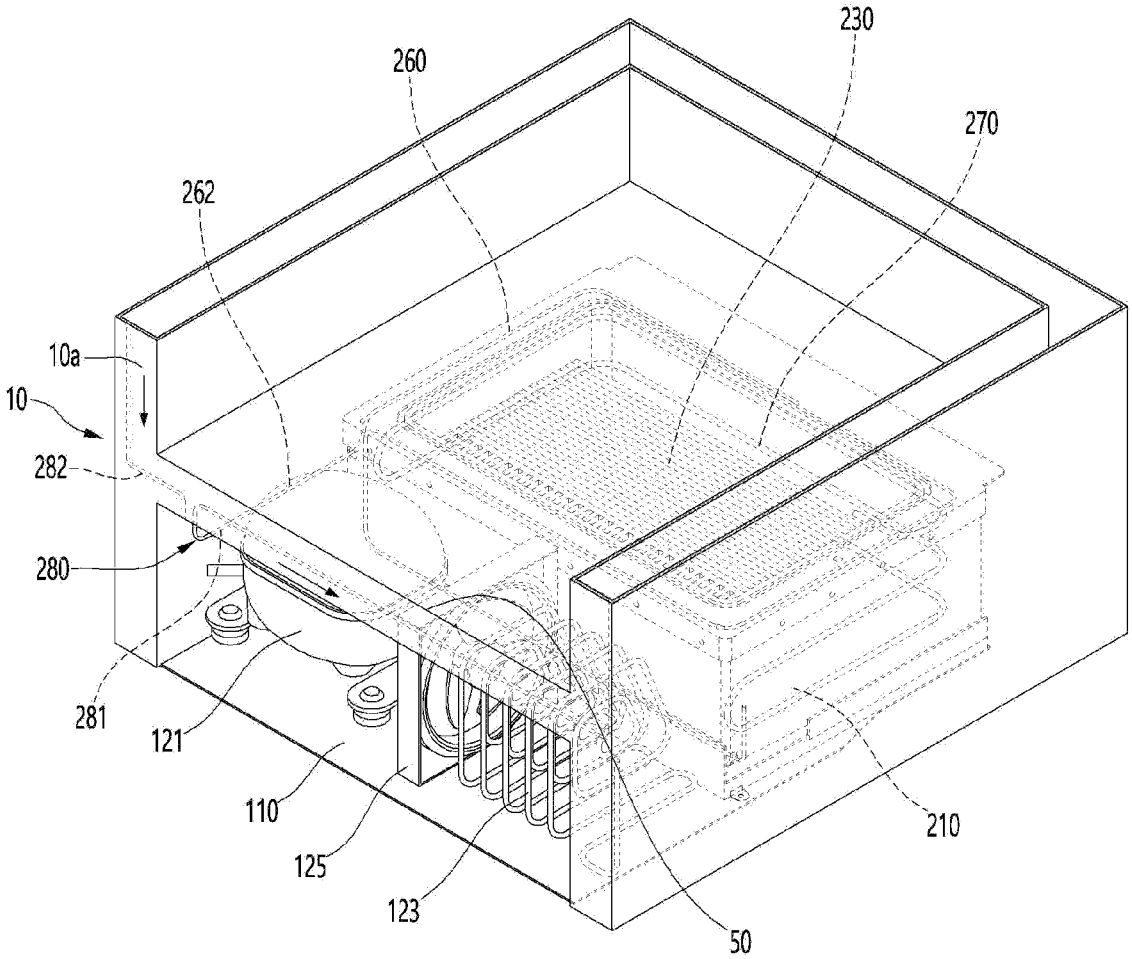
FIG. 24 is a view showing a partial configuration of a heat exchange device and a storehouse body according to an embodiment of the present disclosure.

FIG. 17 is an exploded perspective view of the heat exchanger case, FIG. 18 is a cross-sectional view taken along line 18-18' of FIG. 6, FIG. 19 is a cross-sectional view taken along line 19-19' of FIG. 6, FIG. 20 is a cross-sectional view taken along line 20-20' of FIG. 6 and is a view showing the configuration of the heat exchanger case provided with the sealing member, according to a first embodiment, FIG. 21 is an enlarged view of a portion "B" of FIG. 20 and is a view showing the configuration of the sealing member according to the first embodiment, FIG. 22 is a cycle diagram showing the configuration of the heat exchange device according to an embodiment of the present disclosure, FIG. 23 is a perspective view showing the refrigerant flow in the SLHX and the hot line pipe in the heat exchanger case according to an embodiment of the present disclosure, and FIG. 24 is a view showing a partial configuration of the heat exchange device and the storehouse body according to an embodiment of the present disclosure.

Referring to FIGS. 17 to 24, the SLHX 270 according to the embodiment of the present disclosure may be provided in the inside of the second wall or in the vicinity of the second wall defining at least a part of the second storage space 16.

For example, the SLHX 270 may be provided in the inside of the wall of the heat exchanger case 200 or in the vicinity of the wall of the heat exchanger case 200.

The second wall may include a plurality of walls extending in different directions.

The heat exchanger case 200 may include, for example, a case front portion 210*a*, a case side portion 210*b* extending rearward from both sides of the case front portion 210*a*, a case top portion 210*c* forming the upper end portion of the heat exchanger case 200, and a case rear portion 210*d* facing the case front portion 210*a*.

At least one of the plurality of walls may include a wall on which the SLHX is not disposed. Therefore, it is possible to improve flowability of a foaming solution provided for filling the second wall with an insulating material.

For example, the volume of the SLHX 270 provided on the case front portion 210*a* among the plurality of walls constituting the heat exchanger case 200 may be less than the volume of the SLHX 270 provided on the other walls (the case side portion or the case rear portion).

A part of the SLHX 270 provided on the case front portion 210*a* may include a first part 273*a*.

A part of the SLHX 270 provided on the case side portion 210*b* may include a second part 273*b*.

A part of the SLHX 270 provided on the case rear portion 210*b* may include a third part 273*c*.

The first to third parts 273*a*, 273*b*, and 273*c* may be integrally connected as a single body or may be coupled to each other by a separate coupling means.

As another example, the SLHX 270 may not be disposed on the case front portion 210*a*, but may be disposed on the case side portion 210*b* or the case rear portion 210*d*.

The storehouse may include a heat source provided in the inside of the second wall or in the vicinity of the second wall. A heat source may be provided in at least one of the plurality of walls constituting the second wall.

A heat source may be provided in a wall in which the SLHX is not disposed among the plurality of walls.

The heat source may remove or reduce dew that may be generated on the second wall. The heat source may reduce dew that is formed in a portion where the first wall is in contact with the second wall.

For example, the hot line pipe 260 may be provided on the case top portion 210*c* providing the upper wall of the heat exchanger case 200.

The heat source may reduce dew that is formed on a portion of the second wall that faces the second heat exchanger.

A relatively large amount of the hot line pipe 260 may be disposed in the case front portion 210*a* of the heat exchanger case 200 in which a relatively small amount of the SLHX 270 is disposed.

The heat source may include a heater provided as a separate component or a refrigerant pipe through which a high-temperature refrigerant flows.

The refrigerant pipe may be heated by a separate heater.

The refrigerant pipe may include a first portion connected to a condenser configured to condense the refrigerant at a high temperature and a second portion provided in the second wall.

For example, the hot line pipe 260 may include a hot line inlet portion 261 connected to the second heat exchanger 123 and a hot line body 260*a* provided in the heat exchanger case 200.

The second portion may remove or reduce dew that is formed on the second wall.

The refrigerant pipe may include a third portion provided in the first wall. The three portions may be provided in the vicinity of the portion where the first wall is in contact with the door. The third portion may reduce dew that is formed in a portion where the first wall is in contact with the door.

For example, the door side pipe 280 may be connected to the hot line pipe 260, and may be provided in the front wall of the first storage space 15 that is in contact with the door 20.

The SLHX 270 may include a portion where at least three rows are arranged.

For example, the SLHX 270 may include a first heat exchange portion 270*a*, a second heat exchange portion 270*b*, and a third heat exchange portion 270*c* arranged in at least three rows.

At least one of the second part 273*b* and the third part 273*c* of the SLHX 270 may include the first to third heat exchange portions 270*a*, 270*b*, and 270*c*.

A connecting pipe connecting the first row and the second row and a connecting pipe connecting the second row and the third row may be disposed at different positions. As such, when the density at which the refrigerant pipes are disposed is distributed, the flowability of the foaming solution provided for filling the second wall with the heat insulating material can be improved.

The first heat exchange portion 270*a* may constitute the first row among the three rows.

The second heat exchange portion 270*b* may constitute the second row among the three rows.

The third heat exchange portion 270*c* may constitute the third row among the three rows.

The first heat exchange portion 270*a* and the second heat exchange portion 270*b* may be connected to each other through a first connecting pipe at a first edge side of the second wall. For example, the first and second heat exchange portions 270*a* and 270*b* and the connecting pipe may be integrally formed as a single body.

The second heat exchange portion 270*b* and the third heat exchange portion 270*c* may be connected to each other through a second connecting pipe at a second edge side of the second wall. For example, the second and third heat exchange portions 270*b* and 270*c* and the second connecting pipe may be integrally formed as a single body.

The SLHX 270 may be disposed in at least two of the plurality of walls constituting the second wall. Therefore, by extending the length of the SLHX 270, heat exchange efficiency between the first and second refrigerant pipes 275 and 276 can be improved.

For example, the SLHX 270 may be provided in two or more walls among the plurality of walls defining the heat exchanger case 200. For example, the SLHX 270 may be provided on at least two wall surfaces among the case front portion 210*a*, the case side portion 210*b*, and the case rear portion 210*d* of the heat exchanger case 200.

The SLHX 270 may be disposed to surround the edge formed by the plurality of walls that meet each other.

The SLHX 270 may be disposed to surround the edge of the heat exchanger case 210. For example, the SLHX 270 may have a bent shape to surround the edge of the heat exchanger case 210.

The SLHX 270 may be arranged in N rows in one of the plurality of walls, and may be arranged in rows more than N rows in the other one of the plurality of walls. Here, N may be greater than or equal to 0.

The number of rows of the SLHX 270 disposed on the case side portion 210*b* or the case rear portion 210*d* may be greater than the number of rows disposed on the case front portion 210*a*.

For example, the SLHX 270 may be arranged in one row on the case front portion 210*a*.

For example, the SLHX 270 may be arranged in two rows on one side of the case side portions 210*b* on both sides.

For example, the SLHX 270 may be arranged in three rows on the other side of the case side portions 210*b* on both sides.

For example, the SLHX 270 may be arranged in three rows on the case rear portion 210*d*.

The configuration of the heat exchanger case 200 will be described in detail.

The heat exchanger case 200 may include an outer case 211 defining an outer surface and an inner case 212 disposed inside the outer case 211.

For example, the outer case 211 may have a hexahedral shape with an opened upper end.

For example, the inner case 212 may have a hexahedral shape with an opened upper end.

The outer case 211 may be formed to be greater than the inner case 212 so as to accommodate the inner case 212 therein.

First through holes 216*a* and 216*b* through which the hot line pipe 260 pass may be defined in the outer case 211.

The heat source may be provided near the sealing member 240. The heat source may have a shape corresponding to the sealing member 240.

The heat source may be provided between the first storage space 15 and the second storage space 16. The heat source may be provided in a portion where the first storage space and the second storage space are coupled to each other.

For example, the hot line pipe 260 may be provided near the sealing member 240.

The hot line pipe 260 may have a shape corresponding to the sealing member 240.

The hot line pipe 260 may be provided between the first storage space 15 and the second storage space 16. The hot line pipe 260 may be provided in a portion where the first storage space and the second storage space are coupled to each other.

The sealing member 240 may be made of an elastic material so as to be deformable when the partition wall 50 comes into contact with the sealing member 240.

For example, the sealing member 240 may be made of a rubber material.

The heat exchanger case 200 forms a sealing groove 210*e* in which the sealing member 240 is installed. The sealing groove 210*e* may be formed by being recessed downward from the case top portion 210*c*.

The depth of the sealing groove 210*e* may be less than the diameter of the sealing member 240 before the sealing member 240 comes into contact with the partition wall 50.

When the sealing member 240 is seated on the sealing groove 210*e*, a part of the sealing member 240 may protrude upward from the case top portion 210*c*.

The upper end portion of the sealing member 240 may protrude upward from the case top portion 210*c* by a predetermined height H.

The internal volume of the sealing groove 210*e* may be equal to the cross-sectional area of the sealing member 240, or may be slightly greater than the cross-sectional area of the sealing member 240.

When the heat exchanger case 200 is coupled to the partition wall 50 and the case top portion 210*c* of the heat exchanger case 200 is in contact with or very adjacent to the bottom surface of the partition wall 50, the sealing member 240 may be pressed and deformed by the bottom surface of the partition wall 50.

A portion of the sealing member 240 protruding upward from the case top portion 210*c* is inserted into the sealing groove 210*e* by the deformation.

The width of the sealing groove 210*e* may increase as it goes downward.

The sealing groove 210*e* may have a downwardly recessed shape, and the width of the lower end portion 210*e*2 of the sealing groove 210*e* may be greater than the width of the upper end portion 210*e*1 of the sealing groove 210*e*.

The sealing groove 210*e* may include an upper end portion 210*e*1 corresponding to the case top portion 210*c* and a lower end portion 210*e*2 forming the bottom surface of the sealing groove 210*e*.

The sealing groove 210*e* may further include a middle portion 210*e*3 that extends obliquely so that the width of the sealing groove 210*e* increases from the upper end portion 210*e*1 toward the lower end portion 210*e*2.

The edge area where the middle portion 210*e*3 and the lower end portion 210*e*2 meet each other may provide an area in which a part of the sealing member 240 is located when the sealing member 240 is pressed and deformed by the partition wall 50.

Figure 27:
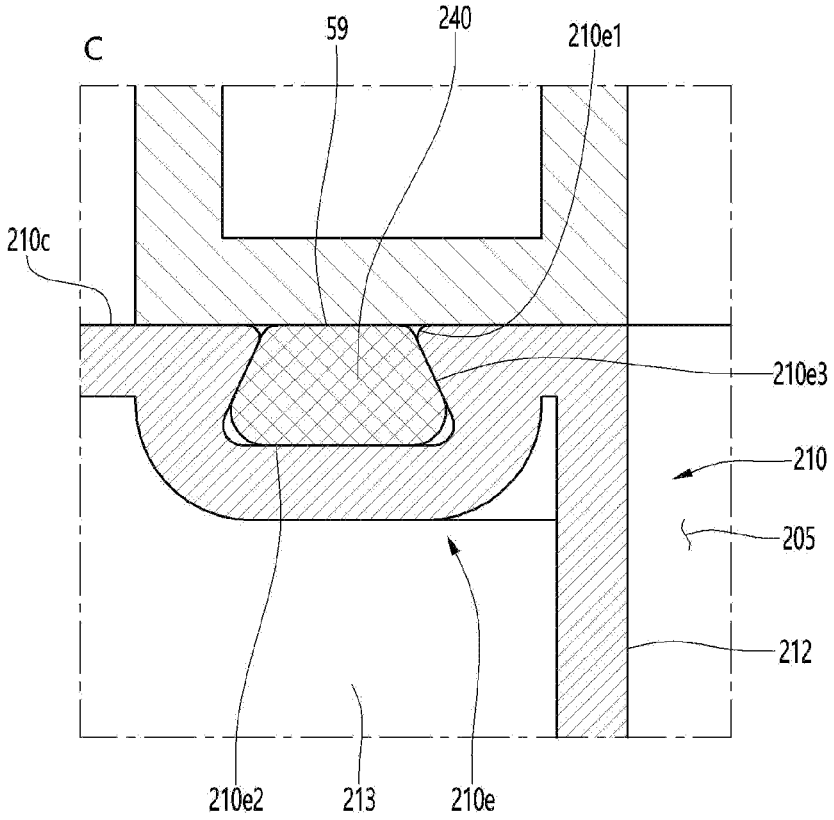
FIG. 27 is an enlarged view of a portion "C" of FIG. 26.

When the heat exchanger case 200 is coupled to the partition wall 50, the partition wall 50 may be in contact with the sealing member 240 and may be in contact with or very adjacent to the case top portion 210*c* (see FIG. 27).

A high-temperature liquid refrigerant condensed in the second heat exchanger 123 may flow through the hot line pipe 260. The refrigerant discharged from the second heat exchanger 123 may flow through the hot line pipe 260 to flow inside or adjacent to the plurality of walls of the heat exchanger case 200.

The hot line inlet portion 261 of the condensing pipe 260 may pass through the first inlet through hole 216*a* among the first through holes 216*a* and 216*b*. The hot line inlet portion 261 may be connected to the discharge side of the second heat exchanger 123 to guide the refrigerant discharged from the second heat exchanger 123 to the heat exchanger case 200.

The hot line outlet portion 262 of the hot line pipe 260 may pass through the first outlet through hole 216*b* of the first through holes 216*a* and 216*b*. The other side 262 of the condensing pipe 260 may guide the refrigerant flowing inside the wall surface of the heat exchanger case 200 to be discharged from the heat exchanger case 200 (see arrow (1 in FIG. 23).

The hot line outlet portion 262 may extend to a body front portion (see 10*a* of FIG. 24) of the storehouse body 10 and be connected to the door side pipe 280. For example, the hot line pipe 260 and the door side pipe 280 may be coupled to each other by a predetermined coupling mechanism or may be integrally formed as a single body.

The door side pipe 280 may be disposed at a portion of the storehouse body 10 that is in contact with the door 20 to reduce dew formation that may occur due to the temperature difference inside and outside the storage space.

The hot line pipe 260 may be disposed along the plurality of walls of the heat exchanger case 200. With this configuration, the condensing pipe 260 may be configured to have a sufficient length.

A hot line body 260 of the hot line pipe 260 may be disposed on the wall of the heat exchanger case 200.

The hot line body 260 may be disposed at a position that does not interfere with the SLHX 270.

For example, the hot line body 260*a* may be provided on a wall where the SLHX 270 is not disposed or a wall where the SLHX 270 is disposed relatively few.

The hot line pipe 260 may be disposed at a point where a first wall defining the first storage space 15 and a second wall defining the second storage space 16 meet each other.

For example, the hot line pipe 260 may be disposed in contact with the case top portion 210*c* of the heat exchanger case 200, or may be disposed adjacent to the case top portion 210*c*.

The hot line pipe 260 may be supported on the second wall by a hot line support portion 214*a*. The hot line support portion 214*a* may include a hook configured to allow the hot line pipe 260 to be inserted thereinto.

The hot line support portion 214*a* may be provided on the case top portion 210*c* so that the hot line pipe 260 is disposed close to the case top surface part 210*c*.

The hot line body 260*a* may include a first pipe portion 263 provided in the first wall of the heat exchanger case 200. For example, the first pipe portion 263 may be provided on the case front portion 210*a*. The first pipe portion 263 may be connected to the hot line inlet portion 261.

The hot line body 260*a* may include a second pipe portion 264 provided in the second wall of the heat exchanger case 200. For example, the second pipe portion 264 may be provided on the case top portion 210*c*. The second pipe portion 264 may be connected to the hot line outlet portion 262.

A wall closest to the first storage space 15 among the plurality of walls may be provided with a relatively more hot line body 260*a* than other walls.

The case top portion 210*c* is a portion forming the wall closest to the first storage space 15 among the plurality of walls defining the second storage space 16 and has a high possibility of dew formation. Accordingly, the case top portion 210*c* may be disposed to surround the edge of the case top portion 210*c* to provide a relatively more hot line pipe.

The hot line body 260*a* may include a third pipe portion 265 connecting the first and second pipe portions 263 and 264 to each other. For example, the third pipe portion 265 may be provided on the case front portion 210*a*.

A distance S1 from the third pipe portion 265 to the outer surface of the case front portion 210*a* may be less than a distance S2 from the SLHX 270 to the outer surface of the case front portion 210*a*. Accordingly, it is possible to prevent dew from being formed on the case front portion 210*a* due to the temperature difference between the second and third storage spaces 16 and 17.

A wall closest to the third storage space 17 among the plurality of walls may be provided with a relatively more hot line body 260*a* than other walls.

The case front portion 210*a* is a portion forming the wall closest to the third storage space 17 among the plurality of walls defining the second storage space 16 and has a high possibility of dew formation. Accordingly, the case front portion 210*a* may be disposed to extend along the edge of the case front portion 210*c* to provide a relatively more hot line pipe.

A part of the first pipe portion 263, the third pipe portion 265, and the second pipe portion 264 may be disposed on the case front portion 210*a*.

The hot line pipe 260 may constitute at least two rows.

The first pipe portion 263 may constitute a first row of the heat exchanger case 200. For example, the first pipe portion 263 may include a lower pipe provided below the heat exchanger case 200.

The second pipe portion 264 may constitute a second row of the heat exchanger case 200. For example, the second pipe portion 264 may include an upper pipe provided on the upper portion of the heat exchanger case 200.

The upper portion of the heat exchanger case 200 may be understood as a portion closer to the first storage space 15 than the lower portion.

The third pipe portion 265 may extend upward from the first pipe portion 263 toward the second pipe portion 264.

The door side pipe 280 is connected to the hot line outlet portion 262 of the hot line pipe 260 and may be inserted into the partition wall 50.

The door side pipe 280 may be provided inside or adjacent to the body front portion 10*a* of the storehouse body 10 through the partition wall 50. For example, the door side pipe 280 may be buried in the body front portion 10*a*.

For example, the door side pipe 280 may be bent and extend along the body front portion 10*a*.

The door side pipe 280 may be connected to a dryer 160. The dryer 160 may be connected to the outlet side of the door side pipe 280, and the hot line pipe 260 and the door side pipe 280 may be connected between the second heat exchanger 123 and the dryer 160 based on the refrigerant flow.

The door side pipe 280 may include a first side portion 281 connected to the hot line pipe 260 and a second side portion 282 connected to the dryer 160. For convenience of description, although the first side portion 281 is defined and described, the first side portion 281 may extend integrally from the hot line pipe 260.

The door side pipe 280 is disposed on the body front portion 10*a* to supply heat, thereby preventing dew from being formed on the body front portion 10*a*. The hot line pipe 260 and the door side pipe 280 may be one configuration of a heat source capable of preventing dew from being formed around the first wall or the second wall.

A second inlet through hole 217*a* among the second through holes 217*a* and 217*b* through which the SLHX 270 passes may be formed in the outer case 211. The second outlet through hole 217*b* of the second through holes 217*a* and 217*b* may be defined n the inner case 212.

For example, the second inlet through hole 217*a* may be formed in the case front portion 210*a* of the heat exchanger case 200.

For example, the second outlet through hole 217*b* may be formed in the side wall of the inner case 212.

The heat exchanger 270 may be buried in the wall surface of the heat exchanger case 200 through the second inlet through hole 217*a*, and may be located in the case accommodation portion 205 of the heat exchanger case 200 through the second outlet through hole 217*a*.

The SLHX 270 may include a heat exchanger inlet portion 271 passing through the second inlet through hole 217*a*.

The SLHX 270 may include a heat exchanger outlet portion 272 passing through the second outlet through hole 217*b*.

The SLHX 270 may include a first refrigerant pipe 276 through which the refrigerant evaporated in the first heat exchanger 220 flows in order to suck a gas-phase refrigerant into the compressor 121, and a second refrigerant pipe 275 through which the refrigerant condensed in the second heat exchanger 123 flows.

The first and second refrigerant pipes 275 and 276 may be in contact with each other to exchange heat by conduction.

The second refrigerant pipe 275 may be provided on the outlet side of the dryer 160. The second refrigerant pipe 275 may be inserted into the wall of the heat exchanger case 200 through the second inlet through hole 217*a*, and may be drawn out from the wall of the heat exchanger case 200 through the second outlet through hole 217*b*.

The flow direction of the refrigerant through the second refrigerant pipe 275 may be a direction from the second inlet through hole 217*a* toward the second outlet through hole 217*b* (see arrow (2 in FIG. 23).

The outlet side of the second refrigerant pipe 275 may be connected to a first heat exchanger inlet pipe 225.

The first refrigerant pipe 276 may be provided on the outlet side of the first heat exchanger 220. The first refrigerant pipe 276 may be connected to the first heat exchanger outlet pipe 226. The refrigerant evaporated in the first heat exchanger 220 may flow through the first refrigerant pipe 276.

The first refrigerant pipe 276 may be introduced into the wall of the heat exchanger case 200 through the second outlet through hole 217*b*, and may be drawn out from the wall of the heat exchanger case 200 through the second inlet through hole 217*a*.

The flow direction of the refrigerant through the first refrigerant pipe 276 may be a direction from the second outlet through hole 217*b* toward the second inlet through hole 217*a* (see arrow (3 in FIG. 23).

Based on the second inlet through hole 217*a* and the second outlet through hole 217*b*, the flow direction of the refrigerant in the second refrigerant pipe 275 may be opposite to the flow direction of the refrigerant in the first refrigerant pipe 276.

The outlet side of the first refrigerant pipe 276 may be connected to the suction side pipe of the compressor 121. That is, the first refrigerant pipe 276 drawn out from the wall of the heat exchanger case 200 through the second inlet through hole 217*a* may be connected to the suction pipe 121*b* of the compressor 121 disposed outside the heat exchanger case 200. The refrigerant flowing through the first refrigerant pipe 276 may be sucked into the compressor 121.

A first assembling hole 211*a* to be assembled with the inner case 212 by a predetermined coupling member is defined in the outer case 211. The coupling member may be inserted into the first assembling hole 211*a* and coupled to the second assembling hole 212*c* of the inner case 212.

A plurality of first assembling holes 211*a* may be defined along the edge of the outer case 211. A plurality of second assembling holes 212*c* may be defined along the edge of the inner case 212.

The outer case 211 further includes a support bracket 214 configured to support the inner case 211. The support bracket 214 may be provided on the inner surface of the outer case 211 and may protrude from the inner surface.

The support bracket 214 is provided at a position corresponding to the first assembly hole 211*a*, and the coupling member may be inserted into the support bracket 214.

The support bracket 214 may support the outer case 211 and the inner case 212 so that the outer case 211 and the inner case 212 are not deformed when the case insulating material 213 is formed between the outer case 211 and the inner case 212.

A plurality of support brackets 214 may be provided along the inner surface of the outer case 211.

The bottom surface of the outer case 211 may include a second hole defining portion 208*b* for discharging the condensed water toward the tray 130. The second hole defining portion 208*b* may include a through hole.

The second hole defining portion 208*b* may communicate with the first hole defining portion 208*a* of the inner case 212. The first hole defining portion 208*a* may protrude downward from the bottom surface of the inner case 212 and may be connected to the second hole defining portion 208*b*.

The first and second hole defining portions 208*a* and 208*b* may define a drain hole 208.

A case accommodation portion 205 in which the first heat exchanger 220 and the fan assembly 300 are located may be formed in the inner space of the inner case 212.

The inner case 212 may include an insertion portion 212*a* inserted into the outer case 211, and an edge portion 212*b* extending downward from the top portion 210*c* of the inner case 212 and forming the edge of the inner case 212.

The top portion 210*c* of the inner case 212 may define the case top portion 210*c* of the heat exchanger case 200.

A sealing groove 210*e*, in which a sealing member 240 is installed, may be defined in the case top portion 210*c*. The sealing groove 210*e* may be defined by being recessed in the case top portion 210*c*.

The edge portion 212*b* may be disposed outside the outer case 211.

The second assembling hole 212*c* may be defined in the edge portion 212*b*.

The first and second refrigerant pipes (tubes) 260 and 270 through which the refrigerant flows may be installed on the wall surface of the heat exchanger case 200.

The heat exchanger case 200 may be formed between the outer case 211 and the inner case 212 to define the installation space in which the first and second refrigerant pipes 260 and 270 are installed.

For example, the first and second refrigerant pipes 260 and 270 may be supported or coupled to the outer case 211 or the inner case 212.

As another example, the first and second refrigerant pipes 260 and 270 may be supported by the case insulating material 213.

After the first and second refrigerant pipes 260 and 270 are disposed in the installation space of the heat exchanger case 200, a liquid insulating foam may be injected through the third through hole (insulating material through hole) 218. As an example, the insulating foam may include polyurethane.

When the insulating foam is solidified, the case insulating material 213 may be provided. Insulation can be made between the case accommodation portion 205 and the outside of the heat exchanger case 200 by the case insulating material 213.

After the heat exchanger case 200 is assembled, the first heat exchanger 220 may be disposed in the case accommodation portion 205 of the heat exchanger case 200.

Fourth through holes 215*a* and 215*b* (referred to as electric wire through holes) may be formed in the heat exchanger case 200. The fourth through holes 215*a* and 215*b* may include one through hole 215*a* formed in the outer case 211 and the other through hole 215*b* formed in the inner case 212.

A component disposed inside the heat exchanger case 200, for example, an electric wire of a cooling fan 310, a heater, or a sensor, may pass through the fourth through holes 215*a* and 215*b*. The electric wire may be drawn out of the heat exchanger case 200 through the fourth through holes 215*a* and 215*b* inside the heat exchanger case 200.

Figure 25:
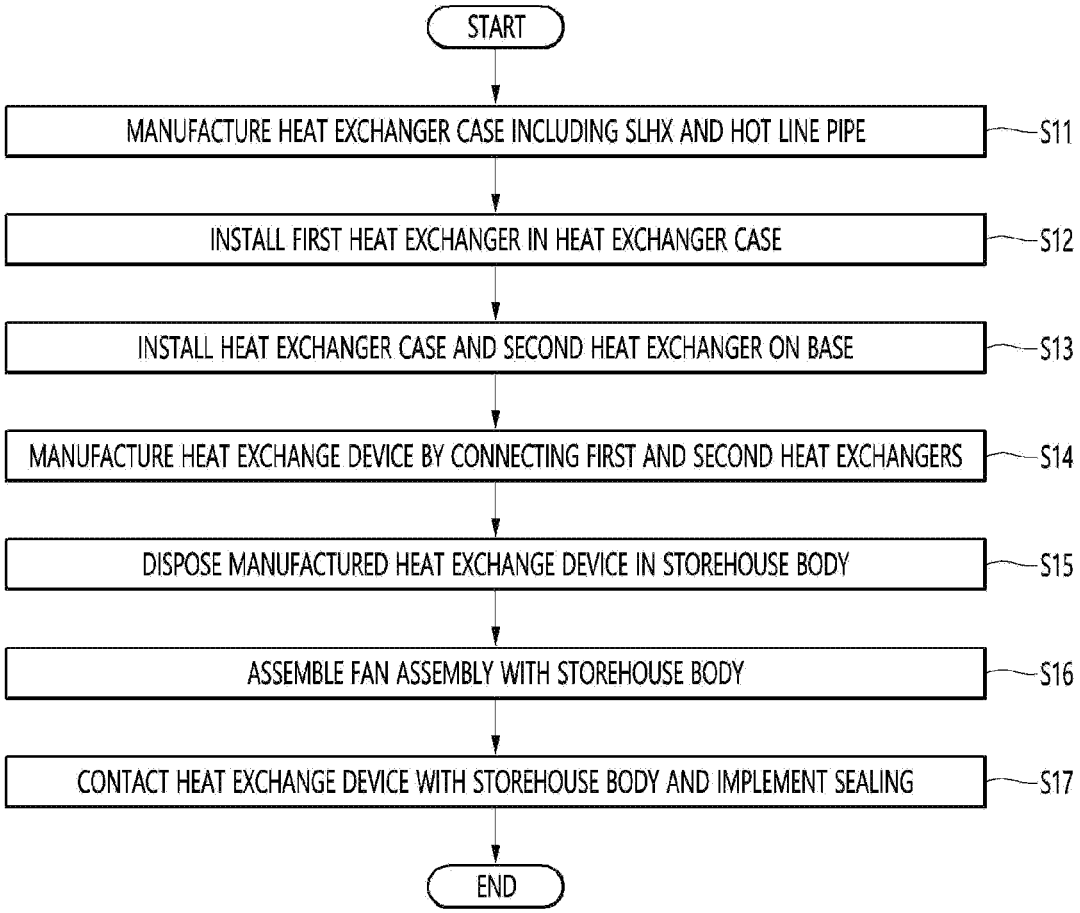
FIG. 25 is a flowchart showing a method for manufacturing a storehouse, according to an embodiment of the present disclosure.
Figure 26:
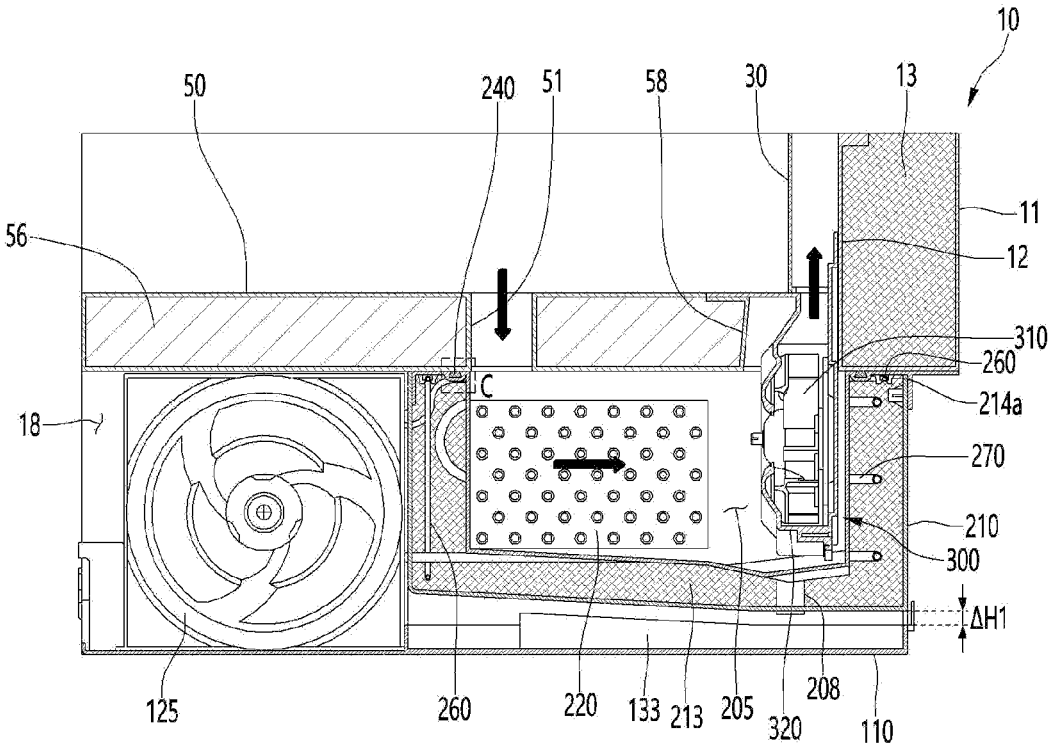
FIG. 26 is a cross-sectional view showing a state in which a heat exchange device is coupled to a storehouse body, according to an embodiment of the present disclosure.

FIG. 25 is a flowchart showing a method for manufacturing a storehouse, according to an embodiment of the present disclosure, FIG. 26 is a cross-sectional view showing a state in which a heat exchange device is coupled to a storehouse body, according to an embodiment of the present disclosure, and FIG. 27 is an enlarged view of a portion "C" of FIG. 26.

A method for assembling the heat exchange device 100 with the storehouse body 10 and an assembly structure, according to an embodiment of the present disclosure, will be described with reference to FIGS. 25 to 27.

The SLHX 270 and the hot line pipe 260 may be disposed in the installation space of the outer case 211 and the inner case 212, and the outer case 211 and the inner case 212 may be assembled. The heat exchanger case 200 is manufactured by injecting an insulating material into the installation space (S11).

The heat exchanger case 200 may define the case accommodation portion 205 in which the first heat exchanger 220 is accommodated. The first heat exchanger 220 may be disposed in the case accommodation portion 205 (S12).

The second heat exchanger 123 and the heat exchanger case 200 in which the first heat exchanger 220 is installed may be installed on the base 110. The compressor 121 and the second fan 125 may be installed on the base 110 together.

The second heat exchanger 123, the compressor 121, and the second fan 125 may be installed in the third storage space 17.

The base 110 may be configured as a common plate for the first and second heat exchangers 220 and 123, and may be configured as a separate plate for separately installing the first and second heat exchangers 220 and 123 (S13).

The heat exchange device 100 may be manufactured by coupling the first and second heat exchangers 220 and 123. In an embodiment, the first and second heat exchangers 220 and 123 may be connected through a pipe as a component constituting the refrigeration cycle. The pipe may be a refrigerant pipe (S14).

The heat exchange device 100 may be disposed in the storehouse body 10.

The heat exchange device 100 may be inserted through the opened front end portion of the device accommodation space 18.

The heat exchange device 100 may slide into the device accommodation space 18.

As another example, the heat exchange device 100 may be fixed at a predetermined position, the storehouse body 10 may be moved toward the heat exchange device 100, and the heat exchange device 100 may be inserted into the device accommodation space 18.

When the heat exchange device 100 is inserted into the device accommodation space 18, the upper portion of the heat exchanger case 200 may be located below the partition wall 50.

The upper end portion of the heat exchanger case 200 may be in a state of being spaced downward apart from the bottom surface of the partition wall 50, and the sealing member 240 installed in the heat exchanger case 200 may be in a state of not being in contact with the bottom surface of the partition wall 50 (S15).

A fluid generator may be disposed downstream of the first heat exchanger 220. The fluid generator may include a fan assembly 300. The fan assembly 300 may include the first fan 310. The first fan 310 may be disposed inside the shroud 320.

For example, at least a part of the first fan 310 may be disposed inside the heat exchanger case 200.

However, the present disclosure is not limited thereto, and the first fan 310 may be installed outside the heat exchanger case 200. For example, the first fan 310 may be disposed inside the partition wall 50. As another example, the first fan 310 may be disposed inside the first storage space 15 or inside the duct 30.

In a state in which the heat exchange device 100 is inserted into the device accommodation space 18, the fan assembly 300 may be assembled with the storehouse body 10 through the partition wall 50 (S16).

By moving the heat exchanger case 200 toward the partition wall 50, the partition wall 50 and the heat exchanger case 200 may be in contact with each other. The heat exchanger case 200 may move until the sealing member 240 comes into contact with the partition wall 50.

The heat exchanger case 200 may move toward the partition wall 50 by a first distance ΔH1.

While the sealing member 240 is in contact with the partition wall 50, the protruding height of the sealing member 240 may decrease or disappear.

The gap between the heat exchanger case 200 and the partition wall 50 may be sealed by the sealing member 240 to prevent the fluid in the heat exchanger case 200 from leaking out from the duct 30.

Various means for moving and coupling the heat exchanger case 200 toward the partition wall 50 may be proposed.

For example, the heat exchanger case 200 may be coupled to the partition wall 50. In detail, a predetermined coupling member may pass through the partition wall 50 and may be coupled to the upper surface of the heat exchanger case 200.

As another example, a lifting device may be provided around the heat exchanger case 200 to lift the heat exchanger case 200 toward the partition wall 50. As another example, a hook device may be provided on the heat exchanger case 200 or the storehouse body 10 so that the heat exchanger case 200 is caught on the storehouse body 10.

Referring to FIG. 27, the sealing member 240 may be in contact with a wall bottom portion 59 of the partition wall 50 in a state of being inserted into the sealing groove 210*e* of the heat exchanger case 200.

The wall bottom portion 59 of the partition wall 50 may be in contact with the case top portion 210*c*. As another example, the wall bottom portion 59 of the partition wall 50 may be located very adjacent to the case top portion 210*c* even if it does not contact the case top portion 210*c*.

Due to the arrangement of the partition wall 50, the heat exchanger case 200, and the sealing member 240, the inner space of the heat exchanger case 200 and the inner space of the first storage space 15 may be separated from each other.

The temperature of the inner space of the heat exchanger case 200 is higher than the temperature of the inner space of the first storage space 15, but the sealing member 240 may prevent a phenomenon in which the fluid in the storage space 15 flows into the heat exchanger case 200.

From another point of view, a strong flow is generated inside the heat exchanger case 200, but the sealing member 240 may prevent the fluid of the heat exchanger case 200 from flowing into the storage space 15.

The fluid in the first storage space 15 may be introduced into the inside of the second storage space, for example, the inside of the heat exchanger case 200, through the inlet portion 51 of the partition wall 50, and may pass through the first heat exchanger 220. In the process of passing through the first heat exchanger 220, the fluid may flow from the front portion to the rear portion of the first heat exchanger 220. The fluid passing through the first heat exchanger 220 may pass through the first fan 310, and the fluid passing through the first fan 310 may be discharged from the fan assembly 300 through the fan outlet portion 326 of the shroud 320 and may flow into the duct 30.

Hereinafter, second and third embodiments of the present disclosure will be described. These embodiments differ from the first embodiment in the configuration and arrangement structure of the sealing member, but is equal to or very similar to the first embodiment in the configuration of the heat exchange device and the storehouse body. Accordingly, the description and reference numerals of the first embodiment are used for the same parts as those of the first embodiment.

Figure 28:
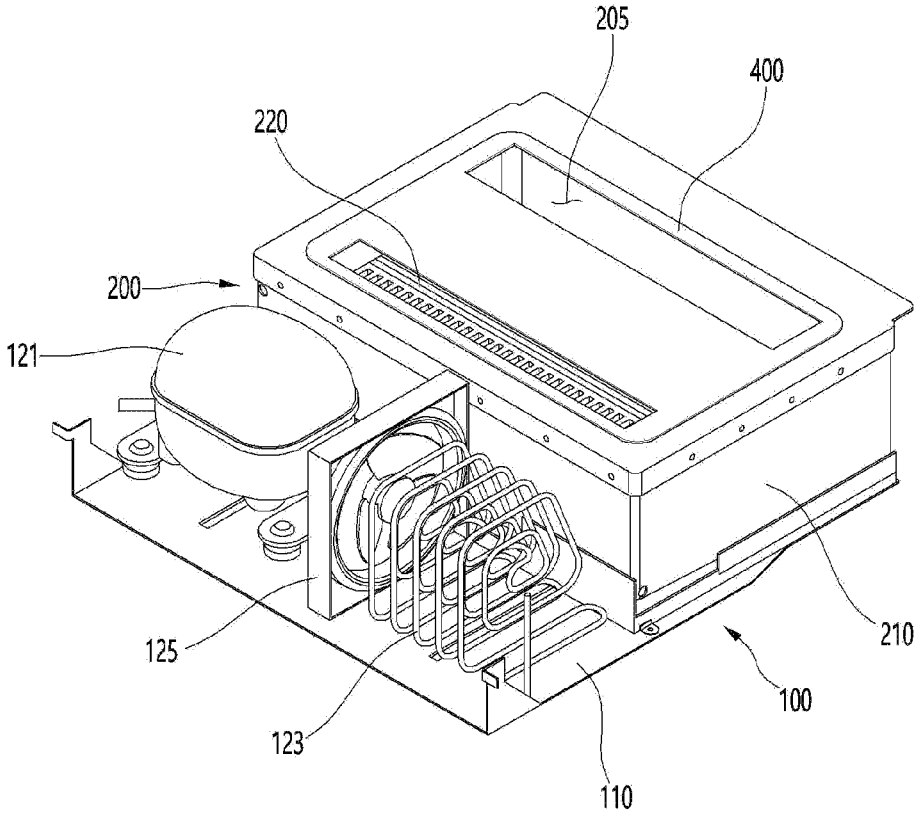
FIG. 28 is a view showing a configuration of a heat exchange device, according to a second embodiment of the present disclosure.
Figure 29:
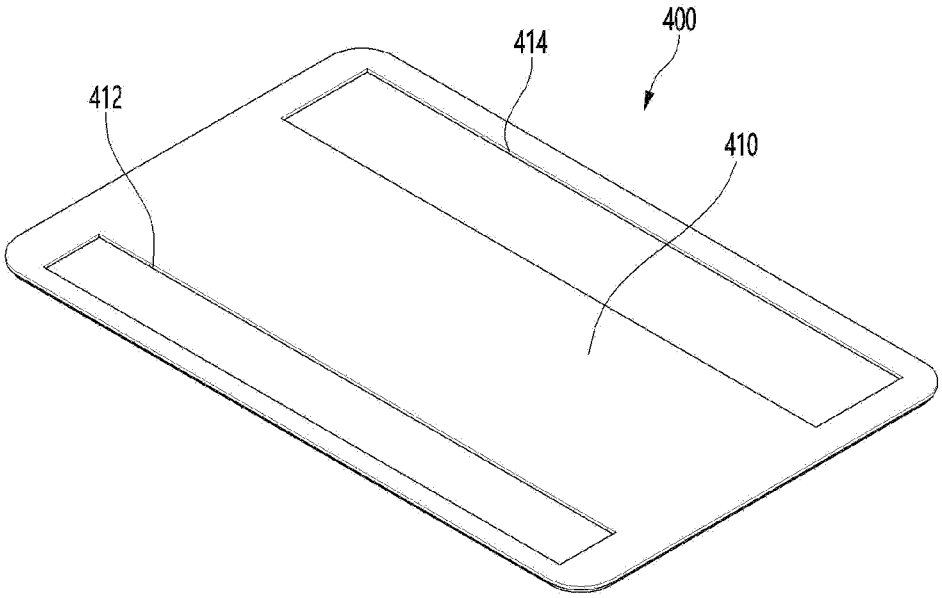
FIG. 29 is a top perspective view showing a configuration of a case cover according to a second embodiment of the present disclosure.
Figure 30:
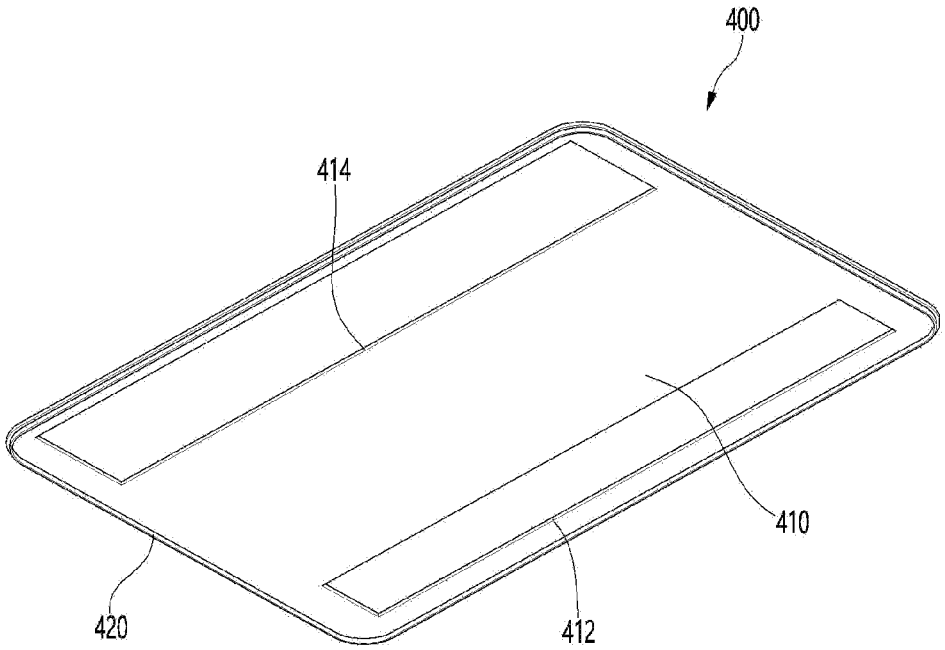
FIG. 30 is a bottom perspective view showing the configuration of the case cover according to the second embodiment of the present disclosure.
Figure 31:
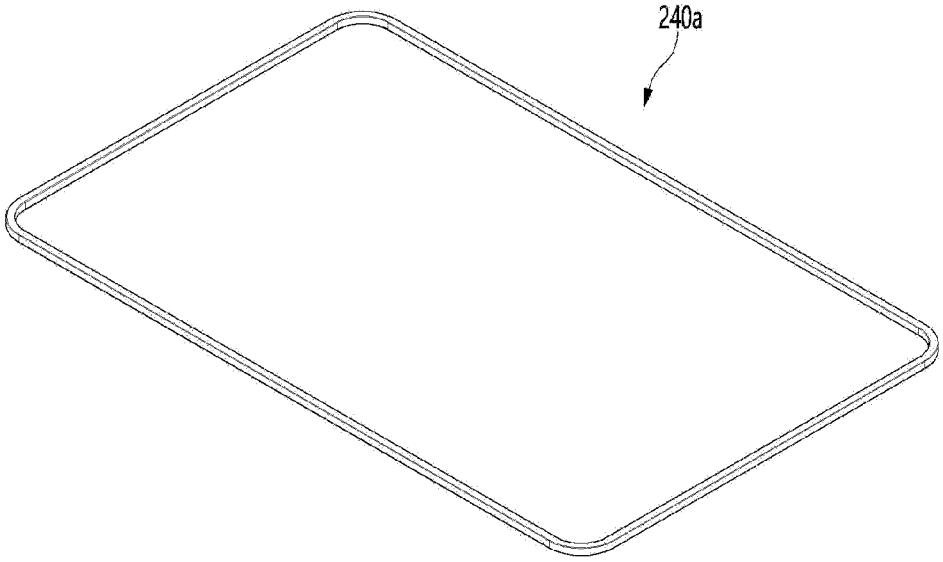
FIG. 31 is a perspective view showing a configuration of a sealing member according to the second embodiment of the present disclosure.
Figure 32:
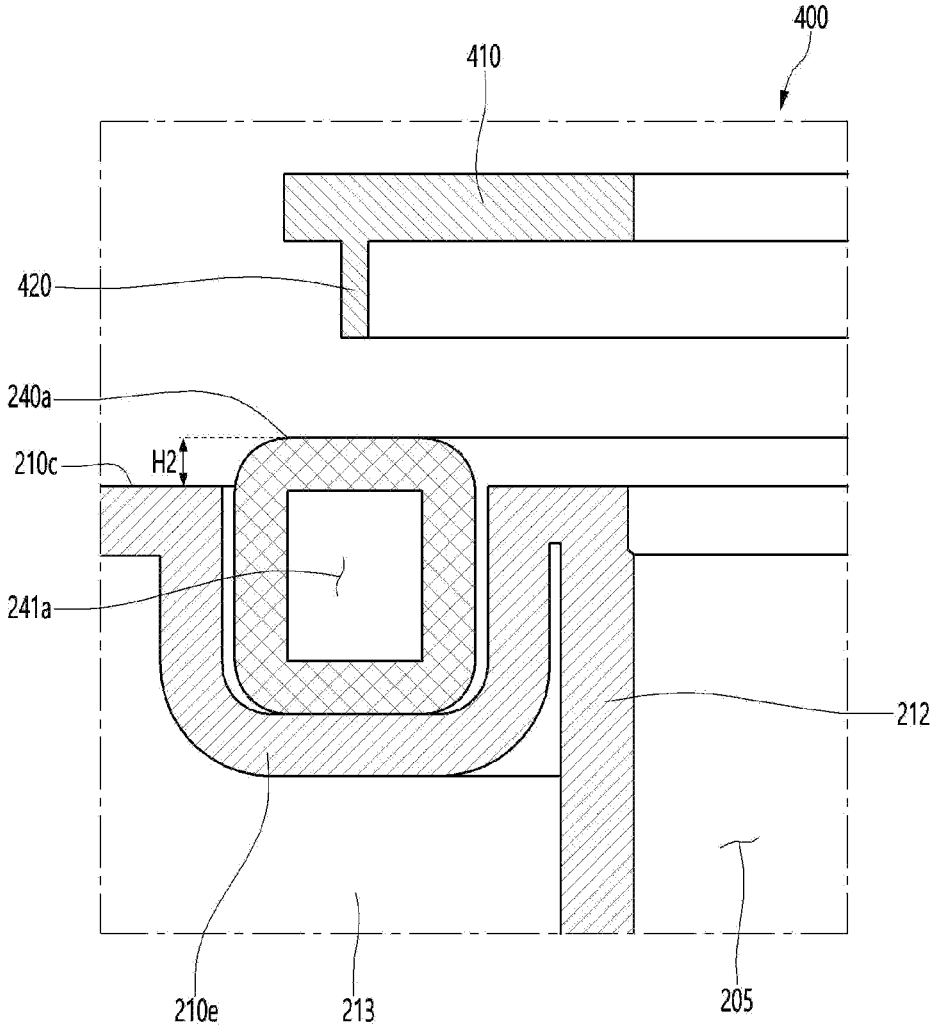
FIG. 32 is a cross-sectional view showing a state before the case cover and the sealing member are coupled to each other, according to the second embodiment of the present disclosure.
Figure 33:
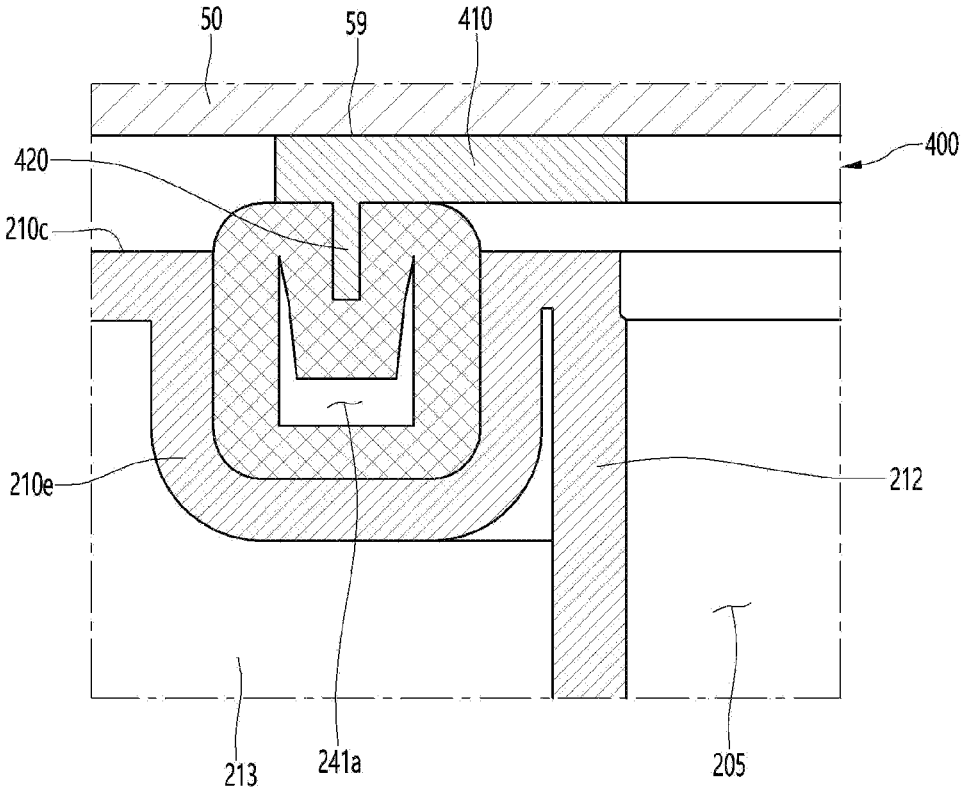
FIG. 33 is a cross-sectional view showing a state after the case cover and the sealing member are coupled to each other, according to the second embodiment of the present disclosure.

FIG. 28 is a view showing a configuration of a heat exchange device, according to a second embodiment of the present disclosure, FIG. 29 is a top perspective view showing a configuration of a case cover according to a second embodiment of the present disclosure, FIG. 30 is a bottom perspective view showing the configuration of the case cover according to the second embodiment of the present disclosure, FIG. 31 is a perspective view showing a configuration of a sealing member according to the second embodiment of the present disclosure, FIG. 32 is a cross-sectional view showing a state before the case cover and the sealing member are coupled to each other, according to the second embodiment of the present disclosure, and FIG. 33 is a cross-sectional view showing a state after the case cover and the sealing member are coupled to each other, according to the second embodiment of the present disclosure.

Referring to FIGS. 28 to 33, the storehouse according to the second embodiment of the present disclosure may include a case cover 400 provided above a heat exchanger case 200.

The case cover 400 may be provided between the heat exchanger case 200 and a partition wall 50.

The case cover 400 may be disposed to cover a part of the opened upper end portion of the heat exchanger case 200. The case cover 400 may be provided above the first heat exchanger 220.

The case cover 400 may be disposed to contact the sealing member 240*a*.

The case cover 400 includes a cover body 410 having an outer shape corresponding to the opened upper end portion of the heat exchanger case 200. For example, the cover body 410 may have approximately a quadrangular plate shape.

The case cover 400 may be provided with a first cover penetration portion 412 formed in the case cover 400 to guide a fluid in the first storage space 15 to be introduced into the heat exchanger case 200.

The first cover penetration portion 412 may be formed in the front portion of the cover body 410, and may be formed so as to penetrate lengthwise in the left-and-right direction.

The first cover penetration portion 412 may be formed at a position corresponding to an inlet portion 51 of the partition wall 50. The first cover penetration portion 412 may be aligned below the inlet portion 51. The fluid in the first storage space 15 may be introduced into the heat exchanger case 200 through the inlet portion 51 and the first cover penetration portion 412.

The case cover 400 may be provided with a second cover penetration portion 414 formed in the case cover 400 to guide a fluid in the heat exchanger case 200 to be discharged to the first storage space 15.

The second cover penetration portion 414 may be formed in the rear portion of the cover body 410, and may be formed so as to penetrate lengthwise in the left-and-right direction.

The second cover penetration portion 414 may be formed to be slightly larger than the first cover penetration portion 412.

The second cover penetration portion 414 may be formed at a position corresponding to the discharge portion of the partition wall 50. The second cover penetration portion 414 may be aligned below the outlet portion. The fluid in the heat exchanger case 200 may be discharged to the storage space 15 through the second cover penetration portion 414 and the discharge portion of the partition wall 50.

A protrusion 420 that is in contact with the sealing member 240*a* may be provided between the partition wall 50 and the heat exchanger case 200.

The protrusion 420 may be provided in the case cover 400. For example, the protrusion 420 may be provided on the bottom surface of the cover body 410. The protrusion 420 may be configured to protrude from the bottom surface of the cover body 410.

The protrusion 420 is provided along the edge of the case cover 400, which may correspond to the shape of the sealing member 240*a*.

The sealing member 240*a* may have a rectangular shape corresponding to the shape of the opened upper end portion of the heat exchanger case 200.

The sealing member 240*a* may be installed on the case top portion 210*c* forming the upper end portion of the heat exchanger case 200.

The sealing member 240*a* may be installed along the edge of the case top portion 210*c*.

The sealing member 240*a* may be made of an elastic material so as to be deformable when the partition wall 50 comes into contact with the sealing member 240*a*.

The sealing member 240*a* may be made of a rubber material.

The sealing member 240*a* may include a polygonal ring having a hollow polygonal cross-section. For example, the polygonal ring may include a rectangular ring.

An empty hollow portion 241*a* may be formed inside the sealing member 240*a*.

When the sealing member 240*a* is seated on the sealing groove 210*e*, a part of the sealing member 240*a* may protrude upward from the case top portion 210*c*. The sealing groove 210*e* may be formed by being recessed along the edge of the case top portion 210*c*.

The upper end portion of the sealing member 240*a* may protrude upward from the case top portion 210*c* by a predetermined height H2.

The case cover 400 may be seated on the upper surface of the heat exchanger case 200. The protrusion 420 of the case cover 400 may press the sealing member 240*a*.

The sealing member 240*a* may be deformed by the pressing of the protrusion 420. The shape of the hollow portion 241*a* may be deformed.

Due to the deformation of the sealing member 240*a*, the protrusion 420 may be inserted into the sealing member 240*a*. As such, due to the configuration in which the protrusion 420 is inserted into the sealing member 240*a*, the case cover 400 may be stably coupled to the heat exchanger case 200.

When the heat exchanger case 200 moves toward the partition wall 50, the case cover 400 may come into contact with the partition wall 50.

The case cover 400 may be in contact with the wall bottom portion 59. Due to this configuration and action, the first storage space 15 and the inner space of the heat exchanger case 200 may be separated from each other.

As an example, as described above, the case cover 400 and the partition wall 50 may be provided as separate components.

As another example, the case cover 400 may be integrally configured with the partition wall 50 to constitute a part of the partition wall 50.

As another example, the case cover 400 may be omitted and the protrusion 420 may be provided directly on the partition wall 50.

Figure 34:
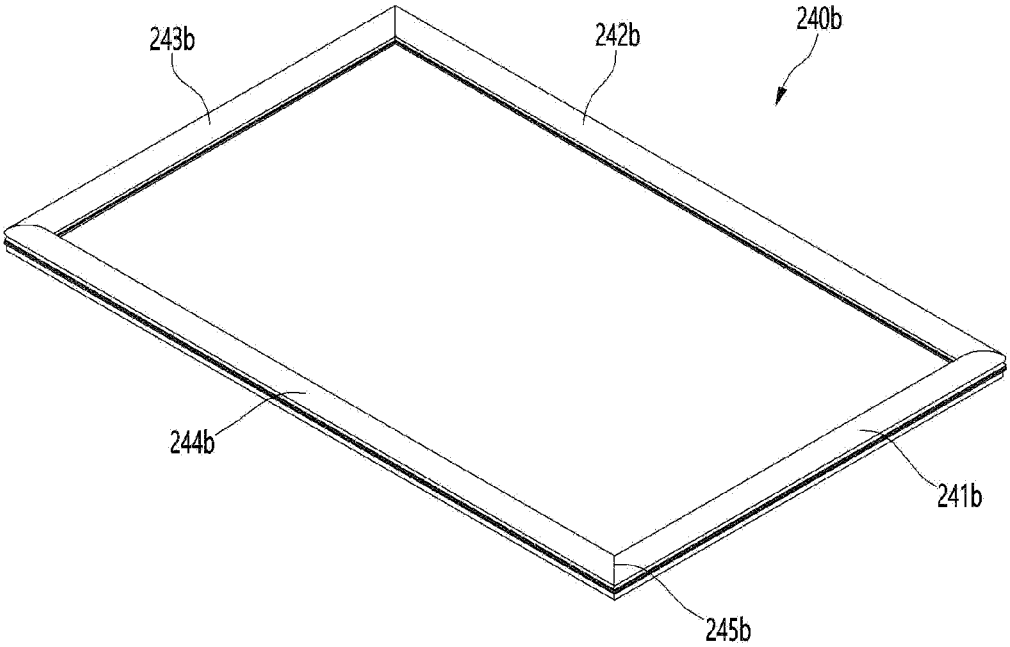
FIG. 34 is a perspective view showing a configuration of a sealing member according to a third embodiment of the present disclosure.
Figure 35:
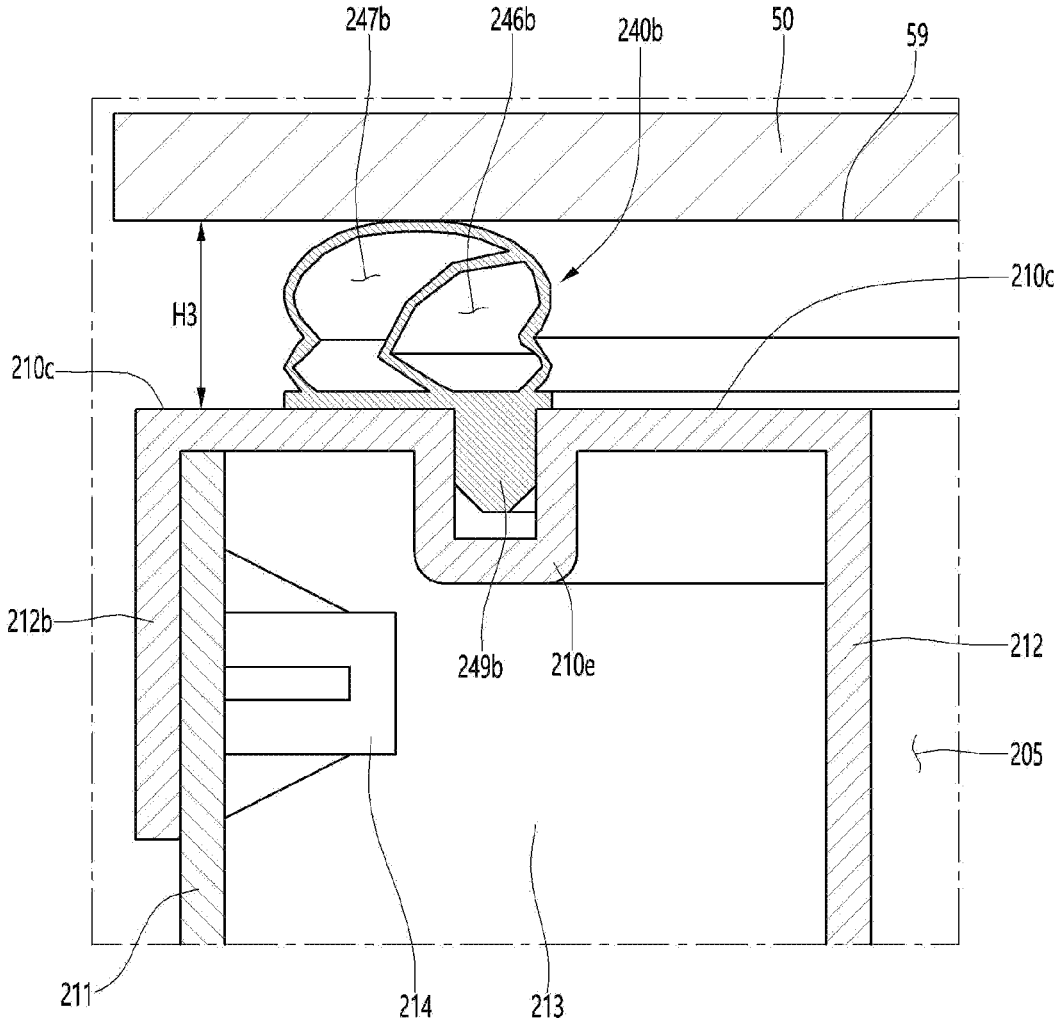
FIG. 35 is a cross-sectional view showing a state before the sealing member and a partition wall of a storehouse body are coupled to each other, according to the third embodiment of the present disclosure.
Figure 36:
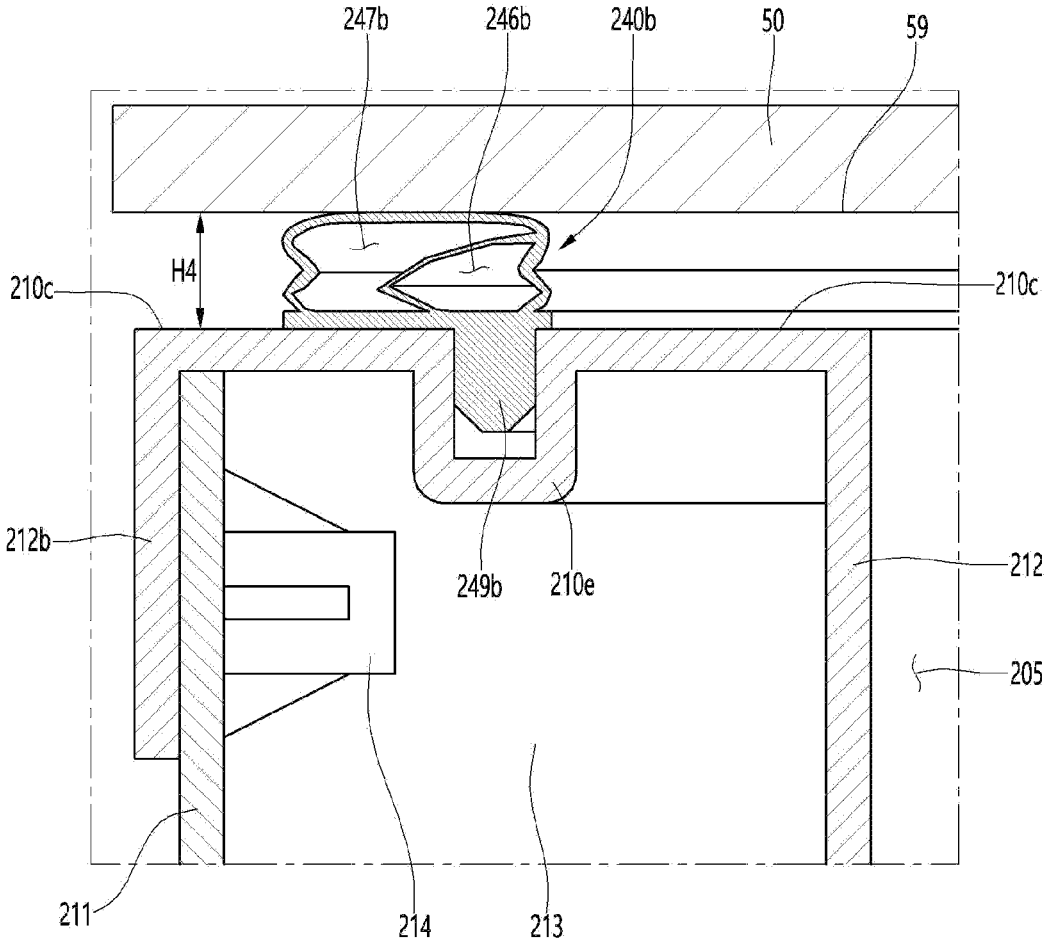
FIG. 36 is a cross-sectional view showing a state before the sealing member and the partition wall of the storehouse body are coupled to each other, according to the third embodiment of the present disclosure.

FIG. 34 is a perspective view showing a configuration of a sealing member according to a third embodiment of the present disclosure, FIG. 35 is a cross-sectional view showing a state before the sealing member and a partition wall of a storehouse body are coupled to each other, according to the third embodiment of the present disclosure, and FIG. 36 is a cross-sectional view showing a state before the sealing member and the partition wall of the storehouse body are coupled to each other, according to the third embodiment of the present disclosure.

Referring to FIGS. 34 to 36, a sealing member 240*b* according to a third embodiment of the present invention may be provided between a heat exchanger case 200 and a partition wall 50 so as to prevent a fluid from leaking out through a gap between the heat exchanger case 200 and the partition wall 50.

The sealing member 240*b* may include a gasket.

The sealing member 240*b* may be made of an elastic material so as to be deformable.

As an example, the sealing member 240*b* may be made of a rubber material.

As another example, the sealing member 240*b* may be made of paper or asbestos material.

The sealing member 240*b* may have a rectangular shape corresponding to the shape of the opened upper end portion of heat exchanger case 200.

The sealing member 240*b* may be installed on the case top portion 210*c* of the heat exchanger case 200.

The sealing member 240*b* may include a first part 241*b* forming a first edge of the rectangle, a second part 242*b* forming a second edge of the rectangle, a third part 243*b* forming a third edge of the rectangle, and a fourth part 244*b* forming a fourth edge of the rectangle.

Both sides of each of the first to fourth parts 241*b*, 242*b*, 243*b*, and 244*b* may be bonded to each other. A boundary surface of the first to fourth parts 241*b*, 242*b*, 243*b*, and 244*b* may form an inclined bonding portion 245*b*.

One or more hollow portions 246*b* and 247*b* may be formed in the sealing member 240*b*.

The one or more hollow portions 246*b* and 247*b* may include a plurality of hollow portions 246*b* and 247*b*, and the plurality of hollow portions 246*b* and 247*b* may be formed to overlap each other vertically or horizontally.

The plurality of hollow portions 246*b*, 247*b*, and 248*b* may include a first hollow portion 246*b* and a second hollow portion 247*b*. The first and second hollow portions 246*b* and 247*b* may have different sizes.

The sealing member 240*b* may further include a sealing protrusion 249*b* inserted into a sealing groove 210*e*.

The sealing protrusion 249*b* may protrude downward from the bottom surface of the sealing member 240*b* and may be fixed to the sealing groove 210*e*.

When the sealing member 240*b* is seated on the sealing groove 210*e*, a part of the sealing member 240*b* may protrude upward from the case top portion 210*c*. The sealing groove 210*e* may be formed by being recessed along the edge of the case top portion 210*c*.

Before the heat exchanger case 200 comes into contact with the partition wall 50, the upper end portion of the sealing member 240*b* may protrude upward from the case top portion 210*c* by a first height H3.

When the heat exchanger case 200 moves toward the partition wall 50, the case cover 50 may come into contact with the sealing member 240*b*. The wall bottom portion 59 of the partition wall 50 may press the sealing member 240*b*.

The sealing member 240*b* may be deformed by the pressing of the partition wall 50. The shape of the plurality of hollow portion 246*b* and 247*b* may be deformed. A second height H4 of the sealing member 240*b* protruding upward from the case top portion 210*c* may be less than the first height H3.

Due to the configuration of the sealing member 240*b* and the contact with the partition wall 50, the first storage space 15 and the inner space of the heat exchanger case 200 may be separated from each other.

INDUSTRIAL APPLICABILITY

According to an embodiment of the present disclosure, first and second storage spaces are fluidly connected to each other. Therefore, the fluid heat-exchanged in a first heat exchanger may be easily supplied to the first storage space, and the fluid in the first storage space may be easily returned to the second storage space. Therefore, the industrial applicability is remarkable.

The invention claimed is:

1. A storehouse comprising:

a first space configured to provide a space in which goods are stored;

a second space configured to provide a space in which a first heat exchanger is accommodated;

a third space configured to provide a space in which a second heat exchanger is accommodated;

a first wall defining at least a part of the first space;

a second wall including a heat exchanger case defining at least a part of the second space;

a third wall defining at least a part of the third space;

a seal provided at a region of where the first wall and the heat exchanger case are in contact with each other; and a heat source disposed in the vicinity of the seal, wherein the heat exchanger case includes a surface that faces the first wall and has a sealing groove in which the seal is installed, the seal contacting the first wall.

2. The storehouse of claim 1, wherein the heat source is provided at at least one of in an inside of the heat exchanger case or in the vicinity of the heat exchanger case.

3. The storehouse of claim 2, wherein the heat source includes a heater.

4. The storehouse of claim 2, wherein the heat source includes a refrigerant pipe through which heated refrigerant flows.

5. The storehouse of claim 4, wherein the refrigerant is heated by a heater.

6. The storehouse of claim 4, wherein the refrigerant pipe includes a first pipe connected to an outlet side of the second heat exchanger or connected to an outlet side of a compressor connected to an inlet side of the second heat exchanger, and a second pipe provided in the heat exchanger case.

7. The storehouse of claim 6, wherein the refrigerant pipe further includes a third pipe connected to the second pipe and extending to an outside of the heat exchanger case.

8. The storehouse of claim 1, wherein the heat source includes a first refrigerant pipe and a second refrigerant pipe, and wherein the heat exchanger case includes a first through hole through which the first refrigerant pipe passes and a second through hole through which the second refrigerant pipe passes.

9. The storehouse of claim 8, wherein the heat exchanger case includes a plurality of walls, the plurality of walls including a first case wall in which the first through hole is formed and a second case wall in which the second through hole is formed.

10. The storehouse of claim 8, wherein the heat exchanger case includes a wall in which the first through hole and the second through hole are formed.

11. The storehouse of claim 8, wherein the heat exchanger case further includes a third through hole through which the first refrigerant pipe passes and a fourth through hole through which the second refrigerant pipe passes.

12. A storehouse comprising:

a first space configured to provide a space in which goods are stored;

a second space configured to provide a space in which a first heat exchanger is accommodated;

a first wall defining at least a part of the first space;

a second wall defining at least a part of the second space; and a seal provided at a region of where the first wall and the second wall are in contact with each other, wherein the second wall includes a heat exchanger case having a plurality of walls connecting with each other, the plurality of walls including an insulator and a pipe provided in the insulator and disposed adjacent to the seal.

13. The storehouse of claim 12, wherein the plurality of walls includes a first case wall extending in a first direction and a second case wall extending in a second direction, wherein the pipe includes a first portion disposed in the first case wall and a second portion disposed in the second case wall.

14. The storehouse of claim 13, wherein the plurality of walls include a first case wall extending in a first direction, a second case wall extending in a second direction and a third case wall extending in a third direction, and wherein the pipe includes a first portion disposed in the first case wall, a second portion disposed in the second case wall and a third portion disposed in the third case wall.

15. A storehouse comprising:

a first space configured to provide a space in which goods are stored;

a second space configured to provide a space in which a first heat exchanger is accommodated;

a third space configured to provide a space in which a second heat exchanger is accommodated;

a first wall defining at least a part of the first space;

a second wall defining at least a part of the second space;

a seal provided at a region of where the first wall and the second wall are in contact with each other; and a heat source disposed in the vicinity of the seal, wherein the second wall includes a plurality of walls, and wherein the heat source is arranged in more than N rows in a first subset of the plurality of walls, and is arranged in N rows in a second subset of the plurality of walls, N being greater than or equal to 0.

16. The storehouse of claim 15, wherein the heat source is provided in at least one of a wall that faces the second heat exchanger or a wall that partitions the second space and the third space.

17. The storehouse of claim 15, wherein the plurality of walls include at least one of:

a wall that faces the second heat exchanger, or a wall that partitions the second space and the third space.

* * * * *